US010676894B2

(12) United States Patent
Sharp

(10) Patent No.: US 10,676,894 B2
(45) Date of Patent: Jun. 9, 2020

(54) BLADE LEVELLING APPARATUS WITH PROVISION FOR MOUNTED ACCESSORIES

(71) Applicant: PROGRESSIVE IP LIMITED, Hamilton (NZ)

(72) Inventor: Rodney Warwick Sharp, Ngaruawahia (NZ)

( * ) Notice: Subject to any disclaimer, the term of this patent is extended or adjusted under 35 U.S.C. 154(b) by 0 days.

(21) Appl. No.: 16/130,446

(22) Filed: Sep. 13, 2018

(65) Prior Publication Data

US 2019/0194907 A1 Jun. 27, 2019

Related U.S. Application Data

(63) Continuation-in-part of application No. 15/317,457, filed as application No. PCT/NZ2015/050071 on Jun. 10, 2015, now Pat. No. 10,323,382.

(30) Foreign Application Priority Data

Jun. 10, 2014 (NZ) ..... 626006
Sep. 23, 2014 (NZ) ..... 700307

(51) Int. Cl.
*E02F 3/76* (2006.01)
*E02F 3/96* (2006.01)
*E02F 3/815* (2006.01)

(52) U.S. Cl.
CPC ..... *E02F 3/962* (2013.01); *E02F 3/7609* (2013.01); *E02F 3/815* (2013.01); *E02F 3/961* (2013.01); *E02F 3/7677* (2013.01)

(58) Field of Classification Search
CPC ..... E02F 3/7609; E02F 3/7631; E02F 3/7618; E02F 3/815
USPC ..... 172/811, 824, 825, 834
See application file for complete search history.

(56) References Cited

U.S. PATENT DOCUMENTS

| | | | |
|---|---|---|---|
| 2,718,719 | A | 9/1955 | Anderson |
| 2,816,375 | A | 12/1957 | Anderson |
| 3,049,820 | A | 8/1962 | Lichti |
| 3,452,828 | A | 7/1969 | Deli |
| 3,631,931 | A | 1/1972 | Frisbee |
| 3,661,214 | A | 5/1972 | Peterson et al. |
| 3,698,490 | A | 10/1972 | King |
| 3,793,752 | A | 2/1974 | Snyder |
| 3,901,329 | A | 8/1975 | Eftefield |
| 3,941,195 | A | 3/1976 | Stedman |

(Continued)

OTHER PUBLICATIONS

International Search Report, PCT/NZ2015/050071, dated Sep. 9, 2015.

*Primary Examiner* — Gary S Hartmann
(74) *Attorney, Agent, or Firm* — Young & Thompson

(57) ABSTRACT

A levelling apparatus, that is typically as used on tractors, excavators and skid-steer vehicles, and references the levelling assembly and mounting options including directly to the existing blade of vehicles as well as other mounting arrangements. Preferred embodiments of a levelling apparatus include a blade body portion and body mounting portion connected by an arrangement of fixed and adjustable linkages, preferably hydraulic, to allow movement of the blade body portion, relative to the body mounting portion, in substantially an up and down direction, as well as rotational movement about an axis perpendicular to the general plane of an attached blade.

18 Claims, 13 Drawing Sheets

(56) References Cited

U.S. PATENT DOCUMENTS

| | | | | |
|---|---|---|---|---|
| 3,998,277 | A * | 12/1976 | Wirt | E02F 3/7618 172/826 |
| 3,999,277 | A | 12/1976 | Wirt | |
| 4,026,368 | A | 5/1977 | Asal | |
| 4,106,795 | A | 8/1978 | Henning | |
| 4,135,584 | A | 1/1979 | Smith et al. | |
| 4,147,218 | A | 4/1979 | Stedman | |
| 4,185,698 | A | 1/1980 | Frisbee | |
| 4,201,268 | A | 5/1980 | Frisbee | |
| 4,253,529 | A | 3/1981 | Nissen | |
| 4,270,617 | A | 6/1981 | Cantarella | |
| 4,405,019 | A | 9/1983 | Frisbee | |
| 4,893,683 | A | 1/1990 | Horsch | |
| 6,105,682 | A | 8/2000 | Recker | |
| 6,273,198 | B1 | 8/2001 | Bauer | |
| 6,688,403 | B2 | 2/2004 | Bernhardt | |
| 6,827,155 | B1 | 12/2004 | Hoffart | |
| 7,008,168 | B2 | 3/2006 | Bernhardt | |
| 7,131,502 | B1 | 11/2006 | Hoffart | |
| 8,118,111 | B2 | 2/2012 | Armas | |
| 10,323,382 | B2 * | 6/2019 | Sharp | E02F 3/815 |
| 2008/0210446 | A1 | 9/2008 | Cherney | |
| 2012/0279735 | A1 | 11/2012 | Ditzler | |
| 2016/0108603 | A1 | 4/2016 | Hoyt | |

* cited by examiner

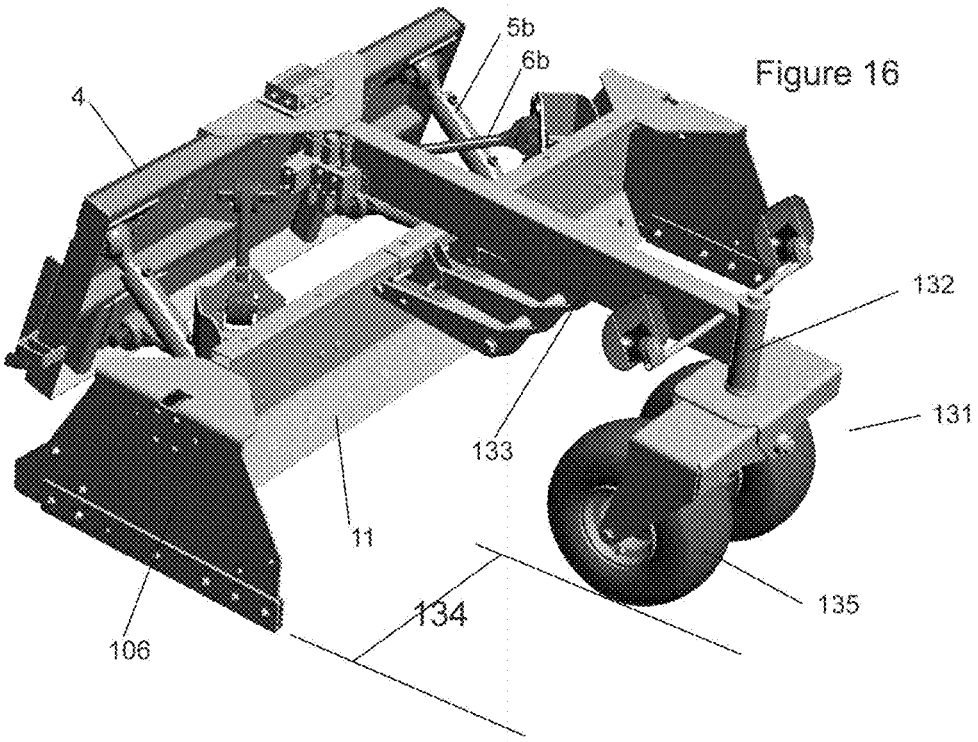
Figure 16
Figure 19
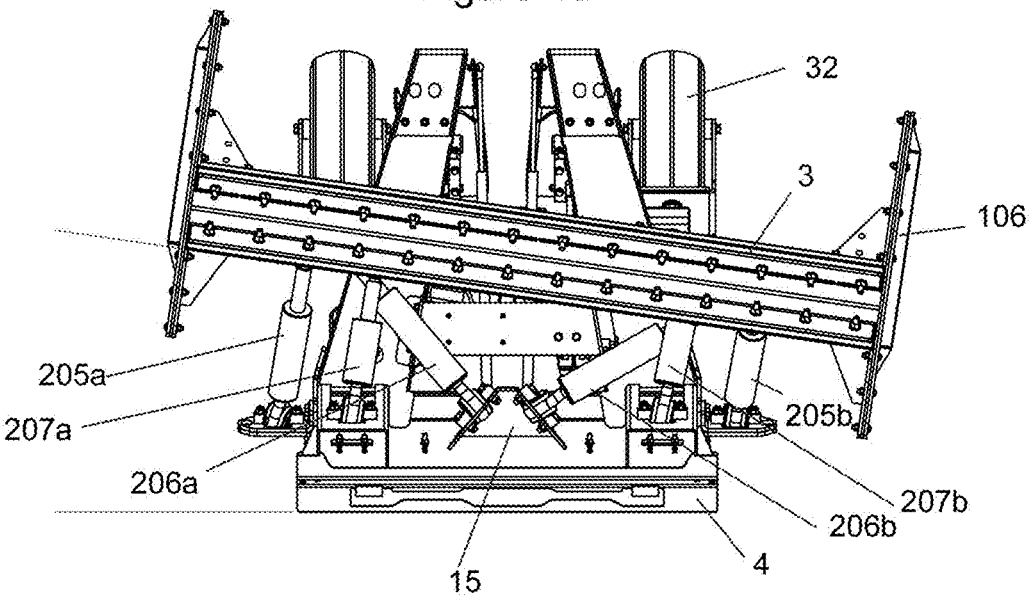

BLADE LEVELLING APPARATUS WITH PROVISION FOR MOUNTED ACCESSORIES

FIELD OF INVENTION

The present invention is directed to levelling apparatus, typically as used on tractors and skid-steer vehicles. The present invention has the ability to vary the inclination of the blade portion, about an axis substantially parallel to the direction of travel during use, as well as normal elevation functions. Other embodiments also allow for additional adjustments to the pitch and/or yaw of a blade portion. Other embodiments allow for the retractable fitting of accessories ahead of the blade portion so that they can benefit from the same attitudinal changes as the blade portion.

BACKGROUND DESCRIPTION

The present invention relates to levellers, a device typically attached to tractors, excavators, and skid-steer vehicles for the purpose of levelling and smoothing the ground. It is envisaged however that the present invention may find other uses, and be adapted therefore.

Levellers take many shapes and designs, including those which are merely dragged along the ground. Many, however, have blades (sometimes known as mould boards) for levelling and altering the contour of the ground. In these versions, the height of the blade is typically able to be altered, which allows the user control over grading, levelling and/or sculpting the contour of the ground. Elevation adjustment is sometimes achieved by raising the entire levelling assembly, while others may rely on merely raising and lowering the portion with the blade. One prior art device uses a central hydraulic actuator to raise and lower the blade portion, which is connected to the main body portion with two dual parallel arm linkages. A wheeled carriage extending from the main body portion helps keep the main body portion at a constant height relative to the ground.

For agricultural applications, generally the contour of the land needs merely to be smoothed. However, levellers have found use in construction sites where they are commonly used to level large areas for foundations, particularly concrete foundations. Here the levelling needs to be precisely, and truly horizontal. Achieving this requires operator skill, and patience. Wheeled versions, such as described above, tend to be most popular as merely raising and lowering the blade (as opposed to the entire leveller assembly) is quicker and more precise, enabling quick responses. When coupled with a laser levelling system, adjusting only the blade elevation allows the operator to work much more quickly.

In many instances, not only must the blade elevation be altered but so too must its inclination relative to the tractor/skid steer to ensure that it is always at true horizontal. If the tractor unit traverses a slope, a fixed inclination blade will level the ground at the same inclination as the tractor unit is. This makes levelling mounds and slopes to the true horizontal extremely difficult.

To address this the prior art uses leveller attachment arrangements (typically the ubiquitous Quick-Hitch) which include an arrangement for varying the inclination of the attachment. These rotational arrangements are expensive, and also add considerable weight to the load carried by the tractor unit. They are also limited in the degree of precision with respect to inclination to a particular angle, and relatively slow to adjust. This slows any levelling operation.

Accordingly, the inventor has identified a need for a levelling unit, which can address the above issues, and at least provide a blade portion able to be adjusted in elevation, and inclination (about a rotational axis substantially the same as the direction of travel), and which can be attached to standard connections such as the Quick Hitch, while avoiding the use of additional rotational assemblies.

In some situations ground preparation work needs to be performed before levelling and grading can occur. In practice this involves working the ground/site with a different implement. For example, where a site is covered with grass or weed, something such as what is commonly known as a "Harley Rake" may be used, which is essentially a powered rotating drum rake. The radially protruding tines on the powered rotating rake penetrate through the upper layer of the ground, to effectively break up thatch, matted plant material, compacted soil, and even light man made surface coverings such as bitumen (depending on the design of the drum). Without this prior treatment the blade tends to skid across the surface of the ground.

In more difficult situations a fixed rake (i.e. not a powered rotating rake) with downward ground penetrating tines may be used to break up harder ground, or where foreign objects which may damage a Harley rake may be present. This solution is more likely to be used on old construction and demolition sites, or where harder man-made coverings of asphalt and bitumen may be present. Again, preparing the ground prior to subsequent operation with a blade assembly allows more effective levelling to be performed.

The problem with the prior art techniques is that the ground must be worked more than once—first with a ground preparing tool, and then the levelling/contouring operation. If the operator has two machines, then one can be preparing the ground while the leveller follows. The disadvantages of these techniques is the extra cost for more tools, the extra time of multiple operations, and the extra cost if more than one tractor is used. To the industry these represent significant disadvantages in terms of time and capital expense. It would therefore be a significant advantage to the groundworking and construction industries if these disadvantages could at least be partially addressed.

Also, more and more operators are using laser guidance systems for controlling their attached implements. The additional speed and accuracy of laser assisted guidance is making it almost a necessity for operators to implement due to remain competitive and meet accelerated timeframe expectations required on many jobs. The downside is that such systems are an expensive investment, and usually they are only implemented on a blade implement, and not on other accessories as well. However, there is still advantage if accessories performing ground preparation work are also able to be controlled by laser guided assistance systems. Apart from reducing the work required by a subsequent blade operation, there are some instances where significant advantage may be obtained.

One such instance is in roadway repair and construction, and by roadway we include paths, sidewalks, carparks, and similar sealed areas. Quite often minimal and subtle grading is required (more for water runoff requirements), and being able to use a laser assisted power rake to prepare sublayers for final application of concrete or asphalt can be advantageous.

It would therefore be of advantage to the roading, groundworking, and construction industries at least, if the additional cost of adding laser guided control systems to individual ground-working accessories could be addressed.

It is also useful for some applications to not only be able to modify the roll characteristics of a blade or accessory, but sometimes also the pitch and/or yaw (using aircraft terminology). This can be dictated by a number of factors, including the terrain and materials being worked, but is sometimes useful. It would therefore be useful if a leveller (and accessory where fitted) could be controlled to provide for adjustments in either or both pitch and roll as well according to user and operator choice.

It is an object of the present invention to address at least some of the above problems.

At the very least it is an object of the present invention to provide the public with a useful alternative choice.

Aspects of the present invention will be described by way of example only and with reference to the ensuing description.

GENERAL DESCRIPTION OF THE INVENTION

According to one aspect of the present invention there is provided a blade levelling assembly comprising a body mounting portion and a blade body portion;

said two body portions being connected by body connecting linkages which allow a substantially up and down vertical movement of the blade body portion, relative to the body mounting portion, and in which the inclination of a blade associated with the blade body portion remains substantially the same regardless of its vertical position;

the body connecting linkages also allowing a rotational movement of the blade body portion, relative to the body attachment portion, about a rotational axis substantially perpendicular to the general plane of said blade;

said body connecting linkages including linear actuators, there being at least one being present either side of the middle of the blade levelling assembly when viewed in plan;

said body connecting linkages also including at least one pivot-ended stabilising linkage either side of the middle of the levelling assembly when viewed in plan;

and wherein the body connecting linkages assist in maintaining relative movement of the body portions to within the rotational and vertical movements as defined above;

the blade levelling assembly being further characterised by including a rotatable accessory mounting portion in turn comprising a transverse accessory mount capable of at least partial rotation about an axis parallel to the general plane of the blade, said rotatable portion being positioned forward of the blade, and above the level of the blade, there being included mount rotation means controlling the rotational attitude of said transverse accessory mount.

According to another aspect of the present invention there is provided a blade levelling assembly, substantially as described above, in which there is provided vertical side guards positioned either side of the blade portion and extending forwardly thereof.

According to another aspect of the present invention there is provided a blade levelling assembly, substantially as described above, wherein said rotatable accessory mounting portion extends between said vertical side guards and are mounted thereto.

According to another aspect of the present invention there is provided a blade levelling assembly, substantially as described above, in which said mount rotation means is capable of alternating the accessory mounting portion, with attached assembly, between at least accessory retracted, and accessory engaged, positions.

According to another aspect of the present invention there is provided a blade levelling assembly, substantially as described above, in which said mount rotation means comprises a linear actuator pivotably connected at one end to said transverse accessory mount, and to the blade body portion at its distal end.

According to another aspect of the present invention there is provided a blade levelling assembly, substantially as described above, in which the mount rotation means is able to be engaged in a free mode, allowing substantially free rotation of the accessory when in an accessory engaged mode.

According to another aspect of the present invention there is provided a blade levelling assembly, substantially as described above, in which affixed to said rotatable accessory mounting portion is a rotatable drum assembly.

According to another aspect of the present invention there is provided a blade levelling assembly, substantially as described above, in which said rotatable drum assembly comprise drum side mounts to which a rotatable drum portion is connected, said drum side mounts connected to said transverse accessory mount and configured to act in conjunction with same to allow the arrangement to alternate between an accessory retracted position in which said rotatable drum portion is above the ground, as well as the level of the lowest edge of the blade assembly, and an accessory engaged position in which the drum is contactable, or in proximity, with the ground.

According to another aspect of the present invention there is provided a blade levelling assembly, substantially as described above, in which said rotatable drum assembly includes drum power means for effecting powered rotation of said rotatable drum portion.

According to another aspect of the present invention there is provided a blade levelling assembly, substantially as described above, in which said drum power means is positioned within the body of the drum.

According to another aspect of the present invention there is provided a blade levelling assembly, substantially as described above, in which said drum power means comprises an inboard hydraulic motor positioned either end within the body of the drum.

According to another aspect of the present invention there is provided a blade levelling assembly, substantially as described above, in which affixed or attachable to said rotatable accessory mounting portion is scarifier assembly.

According to another aspect of the present invention there is provided a blade levelling assembly, substantially as described above, in which said scarifier assembly comprises one or more scarifier modules comprising a plurality of tines.

According to another aspect of the present invention there is provided a blade levelling assembly, substantially as described above, in which the tips of said tines can interact with the ground when in an accessory engaged position.

According to another aspect of the present invention there is provided a blade levelling assembly, substantially as described above, in which the arrangement of the transverse accessory mount and said scarifier modules is such that at least part of a scarifier module can bear against a scarifier support portion to its rear during operation in an accessory engaged mode.

According to another aspect of the present invention there is provided a blade levelling assembly, substantially as described above, in which said scarifier support portion comprises either or both of the mouldboard portion and blade portion.

According to yet a further aspect of the present invention there is provided a multi-adjustable blade levelling assembly for mounting to a vehicle comprising a body mounting portion and a blade body portion;

said body mounting portion and a blade body portion being connected by first and second sets of connecting linkages;

said first set of two connecting linkages characterised by (i) when viewed in plan, being connected to said body mounting portion near its middle, (ii) when viewed in plan being connected to said blade body portion outwardly of its middle;

said second set of two connecting linkages characterised by (i) when viewed in plan, being connected to said body mounting portion outwardly of its middle, and (ii) when viewed in plan being connected to said blade body portion outwardly of its middle, and by a distance substantially the same from the middle as its connection to said body mounting portion;

and wherein either or both of said first and second set of linkages comprise adjustable length actuators.

A multi-adjustable blade levelling assembly for mounting to a vehicle, substantially as described above, in which said adjustable length actuators are hydraulically operated.

According to another aspect of the present invention there is provided a multi-adjustable blade levelling assembly for mounting to a vehicle, substantially as described above, in which said first and second sets of connecting linkages being further characterised by:

(i) being vertically separated from each other when viewed from the side;

(ii) when viewed from the side the mounting points of the connecting linkages of said first set where they connect to the body mounting portion are vertically separated from the mounting points of the connecting linkages of said second set where they connect to the body mounting portion, and (iii) when viewed from the side the mounting points of the connecting linkages of said first set where they connect to the blade body portion are vertically separated from the mounting points of the connecting linkages of said second set where they connect to the blade body portion;

each said arm of said first and second sets of connecting linkages being further characterised by being pivotably connected to said blade body and body mounting portions.

According to another aspect of the present invention there is provided a multi-adjustable blade levelling assembly for mounting to a vehicle, substantially as described above, in which the arrangement is further characterised in that the first and second linkage arrangements allow for both vertical raising, and rotation about an axis normal to the general plane of the blade body portion, while maintaining substantially the same forward inclination of the blade body portion, relative to the body mounting portion. According to another aspect of the present invention there is provided a blade levelling assembly, substantially as described above, in which there are provided a set of two body connecting linkages, comprising linear actuators, either side of the middle of the blade levelling assembly when viewed in plan.

According to another aspect of the present invention there is provided a blade levelling assembly, substantially as described above, in which the connection point of the linear actuators of each set to the body mounting portion are vertically displaced relative to each other when the blade levelling assembly is viewed from the side.

According to another aspect of the present invention there is provided a blade levelling assembly, substantially as described above, in which the connection point of the linear actuators of each set to the blade mounting portion are vertically displaced relative to each other when the blade levelling assembly is viewed from the side.

According to another aspect of the present invention there is provided a blade levelling assembly, substantially as described above, in which a pivot-ended stabilising linkage extends diagonally between the two body portions when the blade levelling assembly is viewed in plan.

According to another aspect of the present invention there is provided a blade levelling assembly, substantially as described above, in which pivot-ended stabilising linkages extending either side of the middle of the blade levelling assembly when viewed in plan, connect to the blade body portion at a point near its middle when viewed in plan.

According to another aspect of the present invention there is provided a blade levelling assembly, substantially as described above, wherein a pivot-ended stabilising linkage includes a ball joint at least one end.

According to another aspect of the present invention there is provided a blade levelling assembly, substantially as described above, in which the ball joint includes a spherical resilient bush.

According to another aspect of the present invention there is provided a blade levelling assembly, substantially as described above, in which, when viewed in plan, there is at least one pivot-ended stabilising linkage extending substantially perpendicular to the aforesaid permitted plane of relative movement of the blade portion, and located at a position outwardly of the middle of the blade levelling assembly when viewed in plan.

According to another aspect of the present invention there is provided a blade levelling assembly, substantially as described above, in which there is a substantially symmetrical distribution of pivot-ended stabilising linkages either side of the middle of the levelling assembly, when viewed in plan.

According to another aspect of the present invention there is provided a blade levelling assembly, substantially as described above, in which a said linear actuator is hydraulically operated.

According to another aspect of the present invention there is provided a blade levelling assembly, substantially as described above, in which the blade body portion includes at least one stabilising wheel.

According to another aspect of the present invention there is provided a blade levelling assembly, substantially as described above, in which a said stabilising wheel is alternable between operational and non-operational configurations.

According to another aspect of the present invention there is provided a blade levelling assembly, substantially as described above, in which the body mounting portion is attachable to a vehicle.

According to another aspect of the present invention there is provided a blade levelling assembly, substantially as described above, in which the vehicle is a skid-steer vehicle, an excavator, or a tracked vehicle.

According to another aspect of the present invention there is provided a blade levelling assembly, substantially as described above, in which the body mounting portion attaches by a quick hitch mounting system.

According to another aspect of the present invention there is provided a blade levelling assembly, substantially as described above, in which the body mounting portion attaches to an existing blade mounted on said vehicle.

According to another aspect of the present invention there is provided a blade levelling assembly, substantially as described above, which includes at least one top hook assembly and one bottom hook assembly, for hooking over the top and bottom respectively of an existing blade on a vehicle.

According to another aspect of the present invention there is provided a blade levelling assembly, substantially as described above, in which either or both of the top and bottom hook assemblies contain more than one hook element for hooking over the top or bottom respectively of an existing blade on a vehicle.

According to another aspect of the present invention there is provided a blade levelling assembly, substantially as described above, in which either or both the top and bottom hook assemblies can be tightened for drawing the blade levelling assembly tightly against a said existing blade on a vehicle for mounting thereto, and can be released or relaxed for dismounting therefrom.

According to another aspect of the present invention there is provided a blade levelling assembly, substantially as described above, in which at least one of said hook assemblies affixes to a point of the blade body portion of the blade levelling assembly.

According to another aspect of the present invention there is provided a blade levelling assembly, substantially as described above, when affixed to a vehicle.

According to another aspect of the present invention there is provided a blade levelling assembly, substantially as described above, in which said linear actuators controlling relevant movement of said blade body portion are controlled by a control arrangement coupled to a laser assisted guidance system.

According to another aspect of the present invention there is provided a levelling assembly, substantially as described above, when used for ground levelling operations.

According to a further of the present invention there is provided a levelling assembly comprising a body attachment portion and a blade body portion;

the two body portions being connected by body connecting linkages which allow a substantially translational movement of the blade body portion, substantially within a translational plane, relative to the blade body portion;

said body connecting linkages including linear actuators, there being at least one being present either side of the middle of the levelling assembly when viewed in plan;

and wherein the body connecting linkages assist in maintaining relative movement of the body portions to as described above, and which includes a stabilising wheel arrangement on an arm arrangement extending from the body attachment portion.

According to another aspect of the present invention there is provided a levelling assembly, substantially as described in the preceding paragraph, in which the arm arrangement has a pivotable connection allowing the portion on which the stabilising wheel arrangement to pivot upwardly so the stabilising wheel arrangement clears the ground.

According to another aspect of the present invention there is provided a levelling assembly, substantially as described in the preceding two paragraphs, in which the arm arrangement has a pivotable connection allowing the portion on which the stabilising wheel arrangement to pivot upwardly so the stabilising wheel arrangement is positionable substantially over the blade portion.

According to a further aspect of the present invention there is levelling assembly, substantially as described above, which includes an excavator attachment means.

According to a further aspect of the present invention there is levelling assembly, substantially as described above, which includes an upwardly extending mount portion from the body attachment portion, and an excavator quick hitch adaptor connected thereto.

According to a further aspect of the present invention there is levelling assembly, substantially as described above, in which the excavator quick hitch adaptor is pivotably connected to the upwardly extending mount portion.

A preferred use of the present invention is for use in levelling operations. A typical example is a building site which must be levelled, often to true horizontal. Prior to levelling there is like to be mounds, ridges, dips, and various other features in the terrain which must be reformed to being flat and level (typically horizontal, but the final level could be an inclined plane). Prior to levelling, a vehicle travelling across the ground is likely to suffer from a degree of pitch and roll. If the blade is fixed relative to the vehicle then it will be a time consuming and difficult challenge to level the ground. Most skid steer vehicles and the like to which a blade is mounted are able to lift the blade up and down. However rotating them about an axis (such as the direction of travel) to compensate for roll of the vehicle, is only possible when expensive or heavy tilting hitch assemblies are employed to mount the blade to the vehicle—not always a desirable or feasible option, particularly for vehicles such as excavators.

Preferred embodiments of the present invention comprise, in simple form, a body mounting portion—which can be affixed to (or employed as part of) a vehicle—and a blade body portion which includes or can have attached a blade for operations such as ground levelling. A linkage assembly, in preferred embodiments, has a geometry allowing restricted movements of the blade body portion relative to the body mounting portion—which effectively means, when attached to a vehicle, restricted movement of the blade relative to the vehicle.

The linkage assembly, as will be described more completely herein, typically comprises a combination of stabilising linkages (typically of fixed length) and linear actuators, which can be lengthened or shortened to effect relative movement of the blade body portion with respect to the body mounting portion. In preferred embodiments these linear actuators are hydraulically operated, but need not be in all embodiments.

The geometry allows for the blade body portion to undergo several movements relative to the body mounting portion (and hence vehicle). The first is an up and down movement. Here the general plane of the blade can remain substantially the same during the up and down movement, such that the movement is virtually an up and down translational movement—i.e. the general plane of the blade remains substantially within a translational plane. This movement allows the elevation of the bottom of the blade to be altered as the vehicle travels over mounds in the ground. Use may be made of a laser guidance control system to help maintain the bottom of the blade at a particular elevation relative to a ground reference point.

Here the lengthening and shortening of the linear actuators control the up and down movement, while stabilising linkages help prevent rotation of the blade plane about a vertical axis.

Another permitted operation is rotation of the blade body portion about a rotational axis substantially perpendicular to a translational plane such as described above. In other words, typically in preferred embodiments about an axis representing the direction of forward travel of the vehicle. This is the equivalent of that typically allowed for by tilting hitch mounts, except this time the linkage geometry of the levelling device provides this feature at much lesser cost and weight.

Preferred embodiments ideally have a pair of stabilising arms, ideally with ball joint connections at at least one end of each, to also help restrict rotational movement of the general plane of the blade to substantially within a said translational plane as mentioned above—i.e. they help prevent rotation of the blade or blade body portion about a vertical axis as other movements are effected.

Both the translational (i.e. up/down) and rotational movements (about a forward facing axis) mentioned above may be sequentially or simultaneously effected. Specialised embodiments may also allow for some rotation of the blade body portion, or the blade itself, about a transverse (relative to the direction of travel) axis as well.

The aforesaid movements will allow, in the case of a blade levelling assembly mounted to a vehicle performing a ground levelling operation, for the operator to maintain the bottom edge of the blade at a fixed level relative to a reference (within the limits of the capacity of the equipment to compensate for extremes in the level of the ground). With the use of a laser reference level guidance system to control the linear actuators, the blade body portion (and hence blade) can be automatically maintained in an optimal elevation and tilt inclination to effect levelling (relative to a reference plane which need not be horizontal), ultimately within very tight tolerances.

The arrangement is also useful for attachment to excavator mounts, though a different mounting system may need to be adopted body mounting portion. Excavator mounting systems do not typically allow for any rotational (about a forward axis) adjustment of an attached blade—the levelling assembly of the present invention includes this feature, thereby making it possible for excavators to more effectively perform ground levelling operations.

In more advanced embodiments there is provided a stabilising wheel arrangement, typically forwardly of the blade. This wheel arrangement may be alternately between operational (contacting the ground) and non-operational positions. In a preferred arrangement the arm arrangement includes a pivoting connection allowing the end portion (with the stabilising wheel arrangement) to pivot upwardly such that the wheels clear the ground. Preferably the stabilising wheel arm of this embodiment pivots to a perpendicular position or backwardly of perpendicular, and more preferably so that the end arm portion and wheel arrangement are positioned behind the pivotable connection. This arrangement, while simple in hindsight, addresses a few significant issues and provide several realisable advantages.

For instance, one of the problems encountered during use is when an operator comes up to a boundary edge and the stabilising wheel arrangement encounters the boundary (e.g. a fence, wall, geographical feature) before the blade does. This means closest the blade can get may be around 1600-1800 mm from the boundary. By implementing the folding arm arrangement the length may typically be reduced by around 1200 mm depending on the specific design. This is much better for work in close confines. Also, as not all applications of the invention may require the use of the stabilising arm and thus the user has the option of either using the stabilising arm or having it raised, effectively converting the embodiment into a dual purpose utility device.

Additionally, for the transport of manufactured devices (e.g. on a truck or a container), space—particularly length—is critical. The ability to fold, as shown in the following illustrations, can reduce the length by around 40% which significantly decreases transport costs for multiple units when exporting or transporting cross-country.

To further improve the versatility of the present invention, a further specialised embodiment of the present invention allows the levelling assembly to attach directly to the existing blade of a vehicle—useful where a vehicle may not have a blade able to be quickly removed, or at all.

Preferred implementations of these embodiments have at least one first hook like feature for engaging the top edge of an existing vehicle blade, and at least one second hook like feature for engaging the bottom edge of said existing vehicle blade. At least one of said first and second hook like features will include tightening means (typically on a link to the levelling assembly) which allows the levelling assembly to be drawn tight against said existing vehicle blade—and subsequently relaxed for release from the existing vehicle blade. This represent a quick and effective system for securing levelling assembly to an existing blade.

Hence, in summary, ideally the geometry of the linkages between the body portions allow for the rotational angle of the blade portion (and hence blade) to be altered relative to the attachment portion, as well as its elevation relative thereto. In this case we are using the attachment portion as our reference point. In reality the blade edge itself will be come the fixed point, relative to a reference point of true ground level and true horizontal. Hence the blade will be maintained in the same position (as far as is possible) despite changes in the pitch or roll of the vehicle to which the levelling assembly is attached.

To allow for the relatively independent control of each end of the blade portion, the primary stabilising linkages will have pivoting ends—preferably a ball joint—to accommodate the geometry changes as the actuators are extended or contracted. In this case the geometry is chosen also to provide lateral stability of the two body portions, as well as substantially maintaining their distance of separation (major differences here as the blade changes position can affect the outcome for a device mounted on a moving vehicle).

For applications where ground preparation is necessary or desirable, preferred embodiments also include an accessory mounting system to allow for the attachment of accessories such as scarifiers, or Harley rakes and the like. For simplicity of description, reference will be made primarily to fixed tine (non-powered) scarifier rakes and Harley rakes as representative examples for illustrating the principles of this aspect of the invention.

While a simple mounting bar could be added, operators often work between areas with different characteristics. Continuously fitting and removing accessories for when needed or not can make a significant dent in productivity. Hence a more versatile solution enabling a mounted accessory to be deployed when required can potentially make a significant productivity advantage.

In simpler embodiments of a blade levelling assembly there are provided side guards either side of the blade and mouldboard elements. These are ideally strengthened or significantly strong to allow the mounting of an accessory (such as a Harley rake, scarifier, etc.) to be mounted between them. In these simpler embodiments, the complete accessory can be mounted on pivotable mounts on the side guards. This arrangement should allow the mounted accessory to rotate between at least an accessory retracted position, and at least one accessory engaged position (there may be a degree of variation here). While manual means may be used, provision may be made on the mounted accessory for the connection of a linear actuator, connected at its other end to a point on the levelling assembly, to allow rotation of the mounted accessory between the aforesaid accessory retracted and accessory engaged configurations.

In more preferred embodiments, there is provided a transverse accessory mount spanning said side guards, or similarly acting supports. This is rotatably mounted to allow rotation about a transverse axis, typically substantially parallel to the blade or mouldboard. It is typically mounted forwardly of the mouldboard, and the blade, and elevated above the latter. The distance forward of the blade and mouldboard can vary according to the accessory and its operation. While the mounting of a non-powered scarifier could be close to the mouldboard and/or blade, a powered drum such as a Harley rake may benefit from being further forward to allow space between it and the blade for accumulated material. Hence a more universal design of an accessory mount is likely to be further forward, but it is envisaged that the provision of multiple accessory mounts is within the scope of the present invention and it is recognised that only the more forward mounting assembly may be effectively operational (able to rotated between engaged and retracted positions) if implements were fitted to both simultaneously (e.g. a non-powered scarifier at the rear and a Harley rake at the front, for instance).

Referring to the embodiment of a single rotatable accessory mounting portion, there will typically be provided mount rotation means to allow the transverse accessory mount (and any attached accessory) to be managed between the aforesaid accessory engaged and retracted positions. In its simplest form this may be a linear actuator, probably hydraulic in operation, which the operator can control by some means.

A potential advantage of the use of the rotating transverse mount assembly is that a strong and reliable connection can be made between the transverse accessory mount and side support elements (e.g. side guards). Also the mount rotation means can remain connected rather than having to be affixed every time an accessory is changed, fitted, or removed. Also it is possible for the blade levelling assembly to be raised, manoeuvred so the transverse accessory mount is above the accessory, and lowered down (guide plates may be provided) so any connecting pins or attachments can be secured. This can speed the process of fitting, removing, and changing accessories as required.

Where a powered drum, such as a Harley rake, is the accessory, advantage may be obtained by including inboard motors within the body of the drum—as opposed to external chain drives, etc. Such inboard motors may be hydraulic in operation, and fitted at either end of the drum/body portion. This would allow an accessory to extend the full width of the mouldboard and blade, and side guards where present. The potentially realisable advantage in practice is that it enables an operator to work the ground very close to a boundary while working in either direction—where single end chain drive systems are used, working close to a boundary is only possible when the chain arrangement is farthest from the boundary (hence the operator may need to travel to the end, turn around, and come back in the favourable direction).

Where a fixed (non-powered) scarifier is fitted, the scarifier may comprise one or more modules with downward tines which are either connected directly to the transverse accessory mount, or to a mount which itself attached to the transverse accessory mount.

As scarifiers may undergo significant pressure in the forward direction, they may be provided with back support. This could be a fixed bar or element extending from or between the side guards, or like. Alternatively part of the scarifier assembly may bear against the mouldboard and/or blade (though preferably the former) so that the blade body portion bears some of the force acting on the tines/scarifier.

In preferred embodiments there is included an option to allow the mount rotation means to relax—e.g. for a linear actuator to travel without resistance. Where a fixed scarifier, such as above, is used, it is typically doing its primary work when the blade levelling assembly is moving forward. If it is supported at its rear by the mouldboard and/or blade (or other element(s)) then the mount rotation means is temporarily redundant. In preferred operation of a fixed scarifier, it can be more useful for the tines to drag over the ground (instead of penetrating) when the levelling assembly is being reversed. Hence the provision of a relaxed mount rotation means would allow this to happen, though it could be operated when the scarifier needed to be moved to an accessory retracted position.

It is envisaged that this provision to relax the mount rotation means may be useful for various accessories which may be fitted to a transverse accessory mount.

The nature and operation of the embodiment described above will be better described with reference to the drawings.

DESCRIPTION OF DRAWINGS

FIG. 16 is a top-side perspective view of an alternative embodiment of a blade levelling assembly showing a fixed transverse mount arrangement with an embodiment of a scarifier module, and an alternative embodiment of a forward support carriage arrangement.

DESCRIPTION OF PREFERRED EMBODIMENT

Figure 3A:
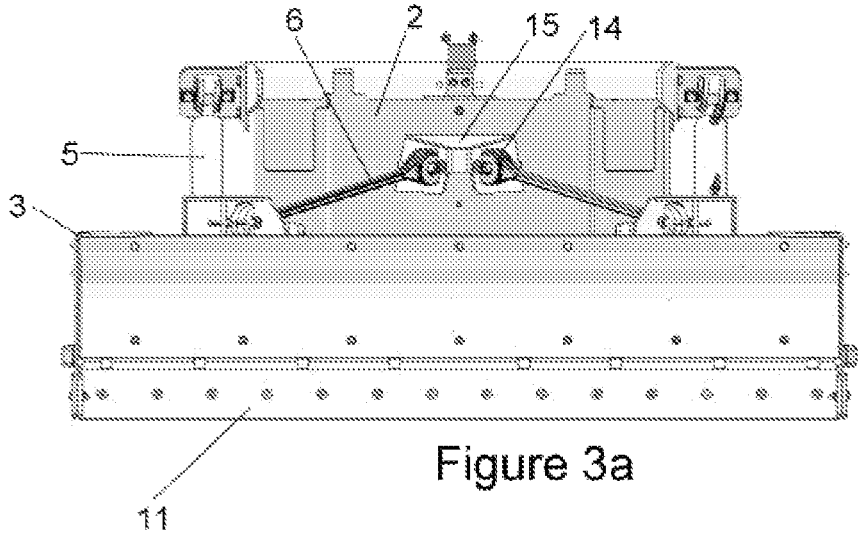
FIGS. 3*a*, 3*b*, and 3*c* are front views of the embodiment of FIG. 1 with the blade lowered, raised, and inclined (about a forward axis), respectively.
Figure 3B:
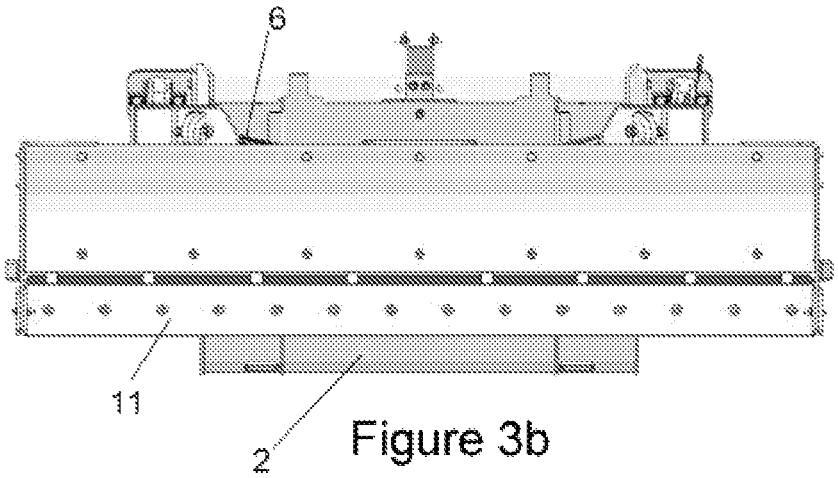
Figure 3C:
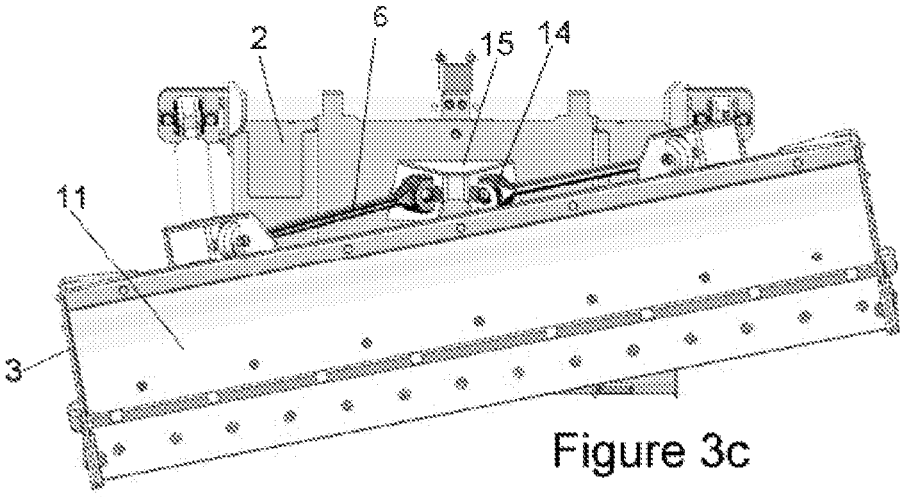

With reference to the drawings (particularly FIGS. 1 and 2), and by way of example only, there is provided a levelling assembly (generally indicated by arrow 1) comprising a body attachment portion (generally indicated by arrow 2) and a blade body portion (generally indicated by arrow 3);

the two body portions (2, 3) being connected by body connecting linkages (5-7) which allow a substantially translational movement of the blade body portion (3), substantially parallel and relative to the blade body portion (2)—see for instance FIGS. 3*a* and 3*b;* the body connecting linkages (5-7) also allowing a rotational movement of the blade body portion (3), relative to the body attachment portion (2), about a rotational axis substantially in the direction of forward travel (9) of the assembly (1)—see for instance FIG. 3*c;* said body connecting linkages including linear actuators (5*a, b*), there being at least one linear actuator (5) being present either side of the middle (10) of the levelling assembly (1) when viewed in plan;

said body connecting linkages (5-7) also including at least one pivot-ended stabilising linkage (6-7) either side of the middle (10) of the levelling assembly (1) when viewed in plan;

and wherein the body connecting linkages (5-7) assist in maintaining relative movement of the body portions to as described above.

The body attachment portion (2) includes a quick-hitch arrangement (4) such as commonly used on skid-steer tractors.

Figure 2:
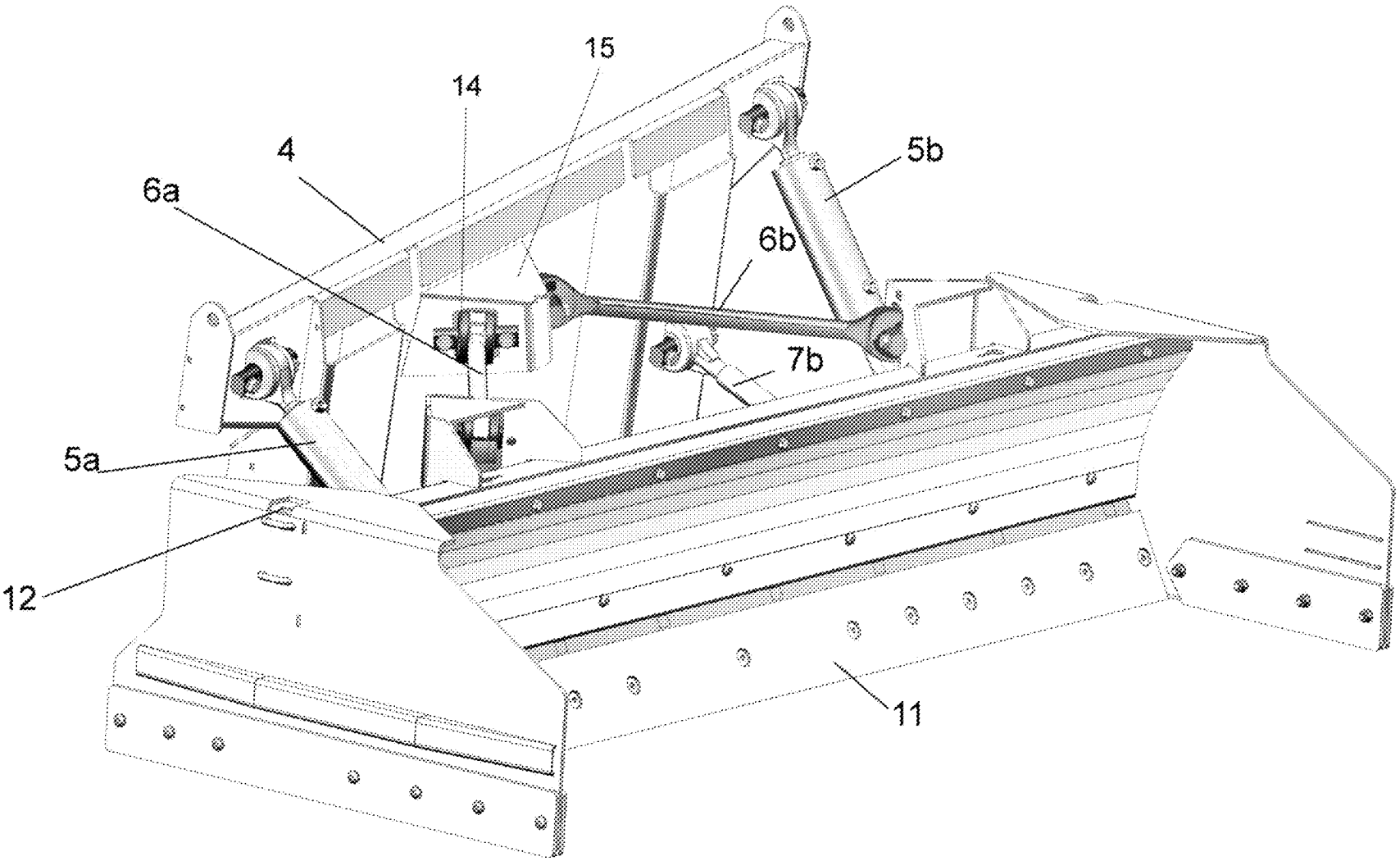
FIG. 2 is a perspective view of the embodiment of FIG. 1 in an alternative configuration.

With reference to FIG. 3 in the illustrated embodiment (1) there are two hydraulically controlled upper linear actuators (5*a, b*) which can be independently controlled to alter the relationship of each end of the blade portion (3) relative to the body attachment portion (2). This is best illustrated in FIG. 2, where right hand actuator (5*b*) is contracted relative to left hand actuator (5*a*) to adopt a configuration such as shown in FIG. 3*c*. While lower linkages (7) may comprise connecting arms, these may also comprise hydraulically controlled lower linear actuators which work in cooperation with actuators (5) to allow the blade body portion to adopt the configurations shown in FIG. 3, and combinations thereof. This arrangement can also allow for alteration of the inclination of the blade (11) about a transverse axis, under the control of the operator.

The stabilising linkages, pivot-ended linkages (6*a, b*) (7*a, b*) have ball joint ends where they attach to at least one of the body portions (2, 3) which is necessary to allow for the permitted relative movements of the body portions (2, 3). In the present invention a spherical bush is used in the joints—this joint (14) can be clearly seen in the stabilising arms (6) where they (in this embodiment) attach to a central mounting point (15) on the body mounting portion (2).

The geometry of the remaining connecting linkages (stabilising arms (6-7)) assist in maintaining the relationship between the two body portions (2, 3) as movement occurs (such as shown in FIG. 3). In this arrangement the distance of separation between the body portions (2, 3) remains substantially the same, as does their relative forward/rearward inclinations (i.e. inclination being rotation about a transverse axis) relative to each other (though some flexibility is allowed here in the design of the geometry in various embodiments).

The primary permitted relative movements between the body portions (2, 3) are, when viewed from the front and wherein the body attachment portion (2) is considered fixed in position, relative upward and downward movement of the blade body portion (3) relative to the body attachment portion (2), as well as allowing relative upward and downward movement of each end of the blade body portion (3) relative to the body attachment portion (2)—allowing also for inclination of the blade portion (3) (relative to the body attachment portion (2)), such as shown in FIG. 2.

Accordingly there is provided a precise alteration of the elevation and rotational inclination of the blade relative to the quick hitch (4) (which follows the roll inclination of the vehicle in response to ground contours) without the need for heavy and expensive quick hitch rotational attachments. The arrangement of the illustrated embodiment theoretically provides for faster (quick response movements are important for a moving vehicle) changes to the elevation and rotational inclination of the blade, as well as being much more precise.

The actuators can also be coupled to a laser levelling control system (sensors or emitters can be mounted on arms (not shown) which fix at positions (12) on the blade portion (3)) so that the blade (11) is maintained at true ground elevation and the horizontal, regardless of any pitching and rolling movements of the vehicle to which it (1) is attached. As mentioned above, the quicker responsiveness of the present embodiment also allows the vehicle to travel faster.

Preliminary trials by the inventor, have indicated that the present invention when used with a laser levelling system can level ground to a much higher degree of precision (±3 mm compared to ±10 mm) approximately 12 times faster than when using a similar arrangement with a prior art device. This represents a very significant advance in the art in terms of productivity and precision. Accordingly this also opens the present invention up to other applications where a tool on a moving vehicle needs to be maintained at a precise inclination and elevation.

Figure 4:
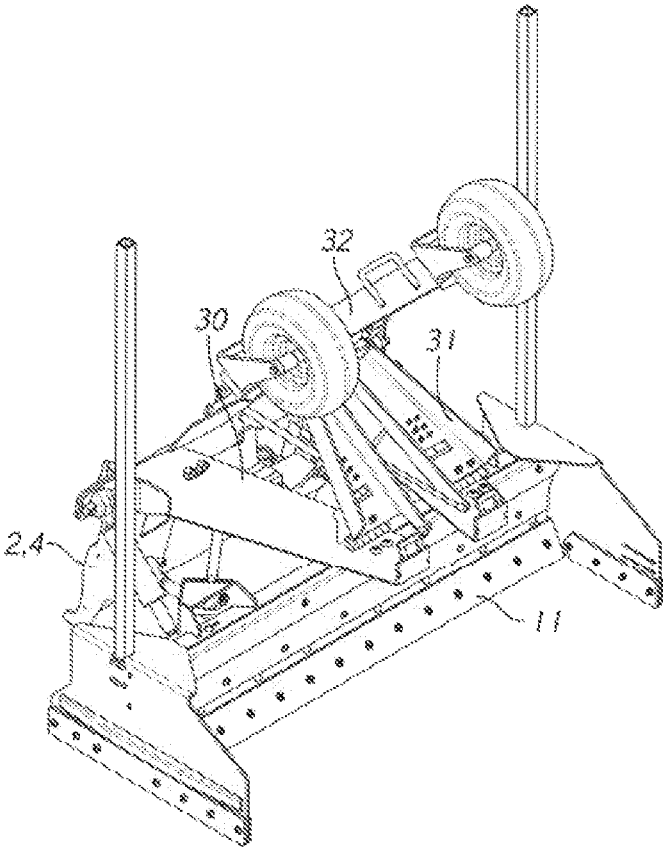
FIG. 4 is a perspective view of an alternative embodiment of the present invention in a folded configuration.
Figure 5:
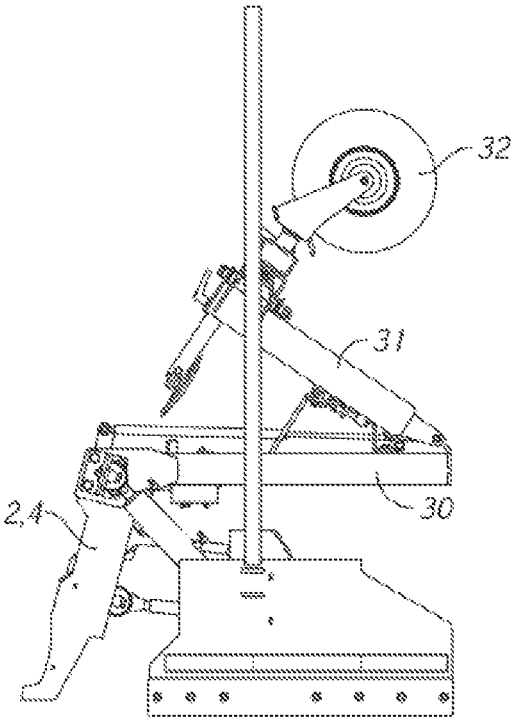
FIG. 5 is a side diagrammatic view of the embodiment of FIG. 3.

In FIGS. 4 and 5 we see a folding embodiment of the present invention, where a provided stabilising arm assembly (30) has a folding end portion (31) on which a ground contacting stabilising wheel arrangement (32) is mounted.

In FIG. 5 the reduced front to rear length of the apparatus is evident, as are the potential transport benefits. Similarly, the closer proximity of the blade (11) to the front of the apparatus, for close work, can be gauged.

Figure 7:
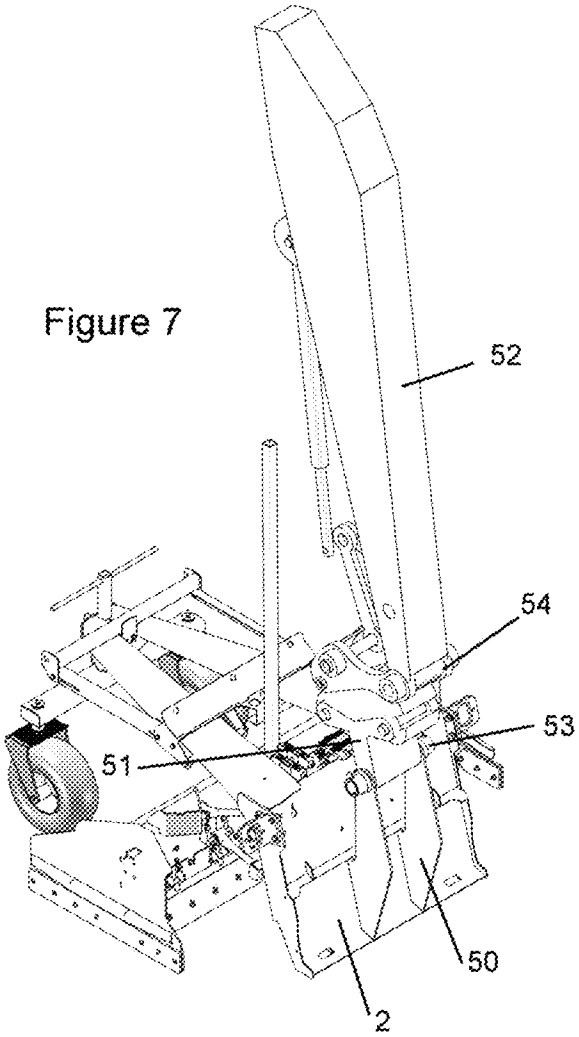
FIG. 7 is a perspective view of the embodiment in FIG. 6.
Figure 6:
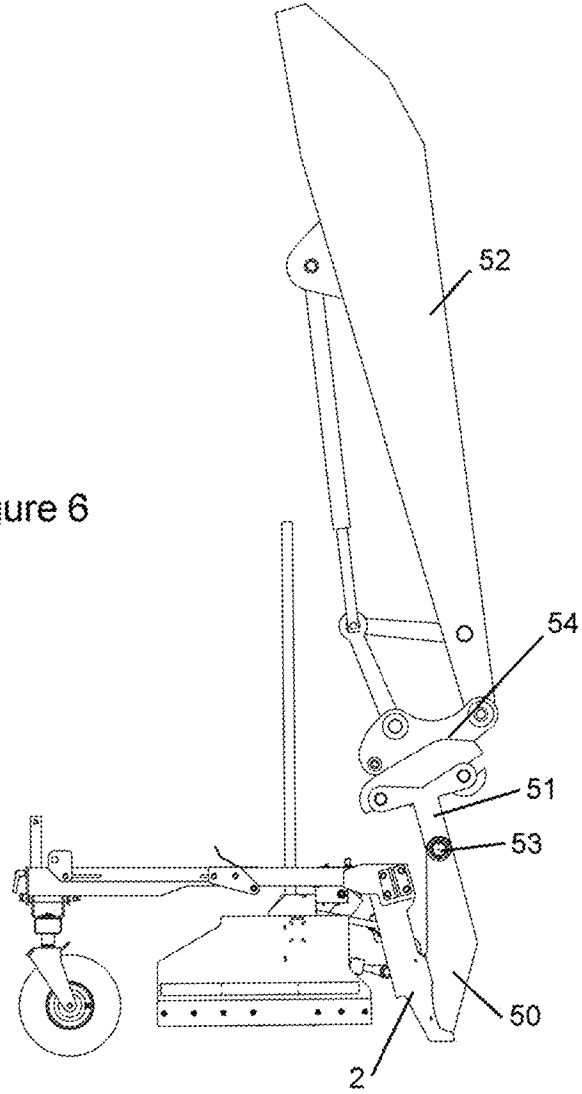
FIG. 6 is a side diagrammatic view of FIG. 4 in an extended configuration.

In FIGS. 6 and 7 we see a further embodiment suitable for attachment to an excavator. Rather than a quick hitch (4) we have an arm arrangement (50) to which is pivotably attached (53) a T-pin (51) comprising a quick hitch adaptor (which may be of different quick connect configurations) to which the quick hitch adaptor (54) of an excavator's (not shown) dipper arm (52) may be attached. This arrangement makes the levelling assembly available for use with excavators, a new and novel arrangement which significantly improves the versatility of both excavators and levelling devices.

Figure 8:
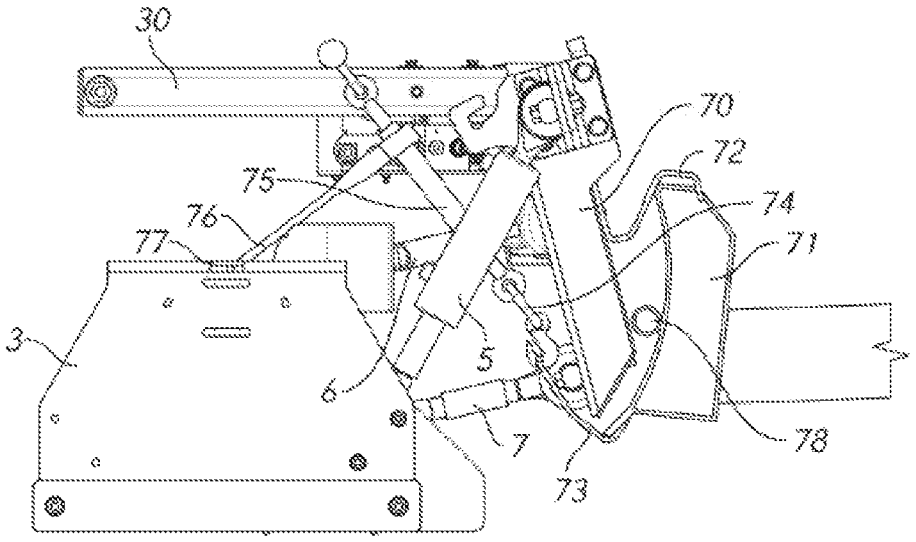
FIG. 8 is a side diagrammatic view of a further embodiment of the present invention attached to the existing blade of a vehicle.
Figure 9:
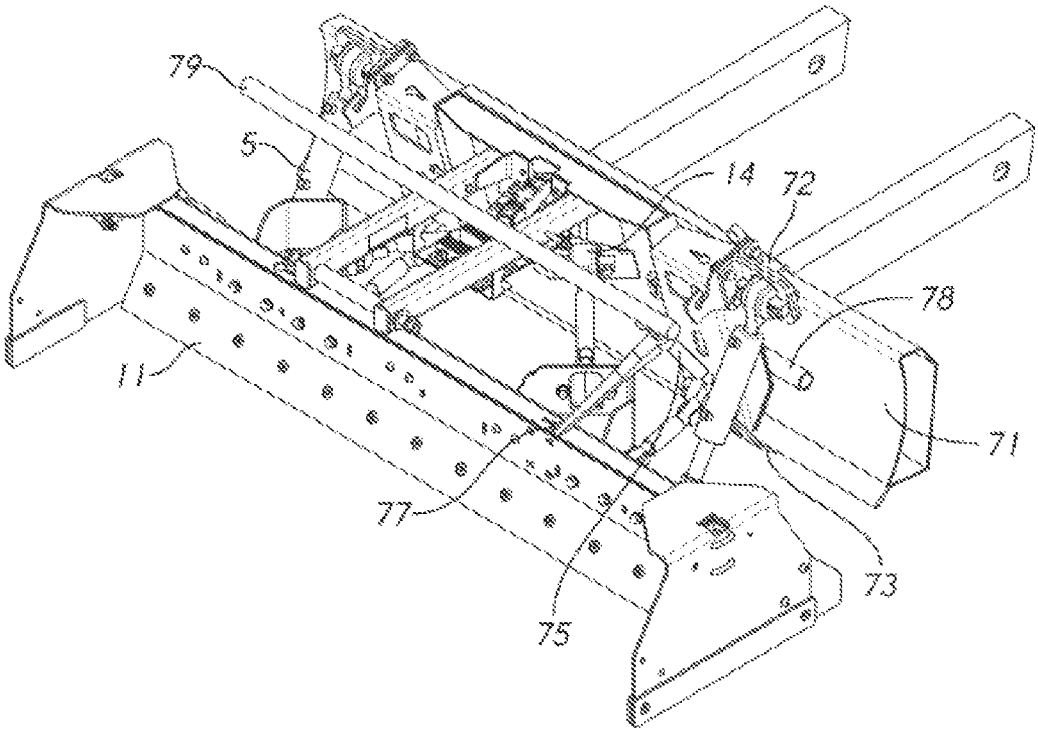
FIG. 9 is a perspective view of the embodiment of FIG. 8.

In FIGS. 8 and 9 we see an alternative mounting system to the ubiquitous quick hitch (4), the body mounting portion (70) attaching to the existing blade (71) of a vehicle (not shown for simplicity).

Here at least one upper hook portion (72) affixed to the body mounting portion (70) hooks over the top of the existing blade (71). A contacting bar (78) may be provided on the body mounting portion (70) to help accommodate the different curves of blades and reduce possible damage to the blade (71).

A lower hook portion (73) connected by a flexible linkage (74) to an adjustable linking element (75), in turn connected to an element (79) associated with the body mounting portion (70), helps secure the levelling assembly (1) to the existing blade (71) as the adjustable element(s) (75) are tightened. The adjustable element (75) may simply be a turnbuckle in a preferred element, and may be provided with an arm (76) to help tighten the turnbuckle, and provide additional stabilisation when the distal end of the arm (76) is connected to a point (77) on the blade body portion (3) after tightening.

Figure 10:
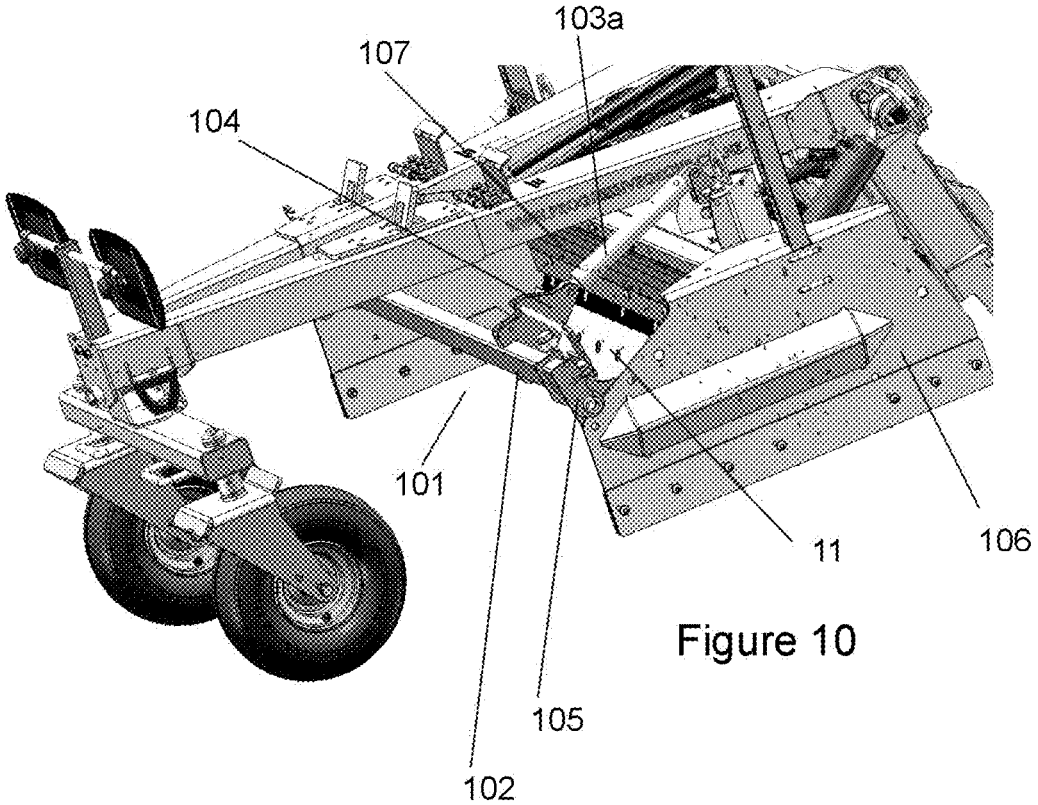
FIG. 10 is a partial perspective view of an embodiment of a blade levelling assembly showing an embodiment of a rotatable accessory mounting portion, without fitted accessory, in an accessory retracted position.

In FIG. 10 we see an embodiment of a modified leveller assembly including a rotatable accessory mounting portion (101) comprising a transverse accessory mount (102), in simplest form comprising rectangular hollow section bar, connected at each end to side supporting elements (in this case comprising side guards) (106) by rotatable mounts (105) allowing at least partial rotation of the mount (102) about a transverse axis substantially in parallel with the general plane of the blade (11) or mouldboard (107) of the blade body portion.

Linkage tabs (104*a,b*) allow for control of the rotation of the mount (102) by allowing the connection of mount rotation means comprising linear actuators (103*a,b*). In preferred embodiments these are hydraulic and capable of progressive and continuous control by the operator, and/or could be linked into an automated control system. In this figure the mount (102) is shown in an accessory retracted position.

Figure 11:
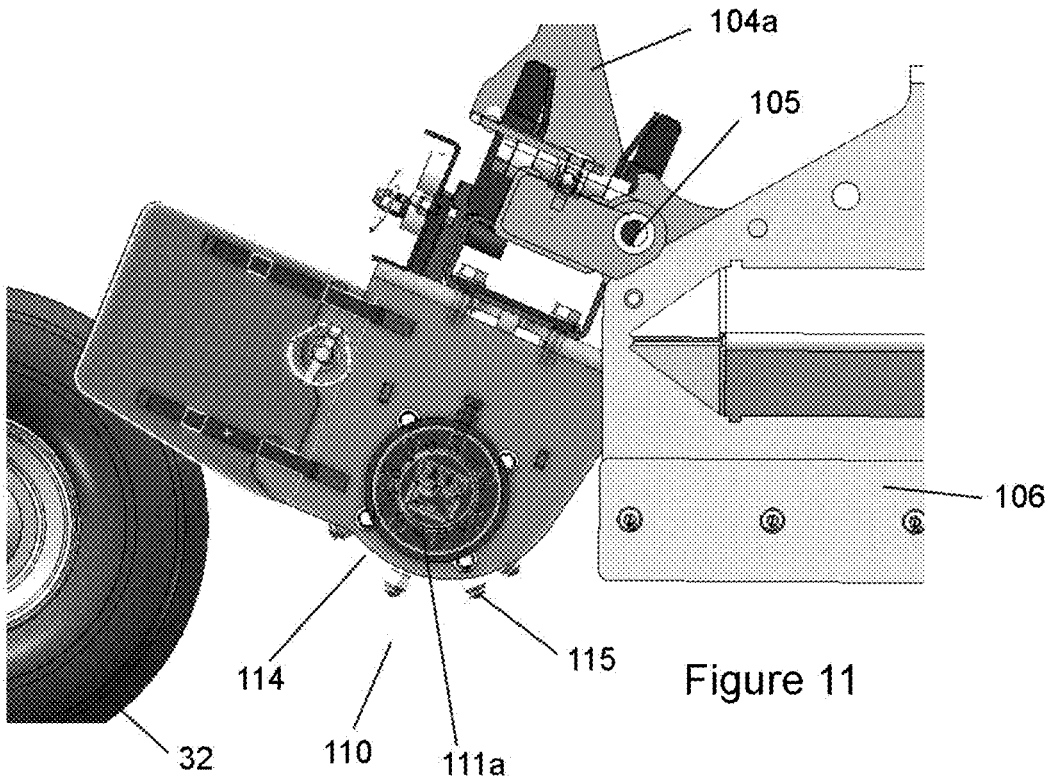
FIG. 11 is a part side view of the embodiment of FIG. 10 with an embodiment of an accessory comprising a power drum fitted and in a position between retracted and engaged configurations.
Figure 12:
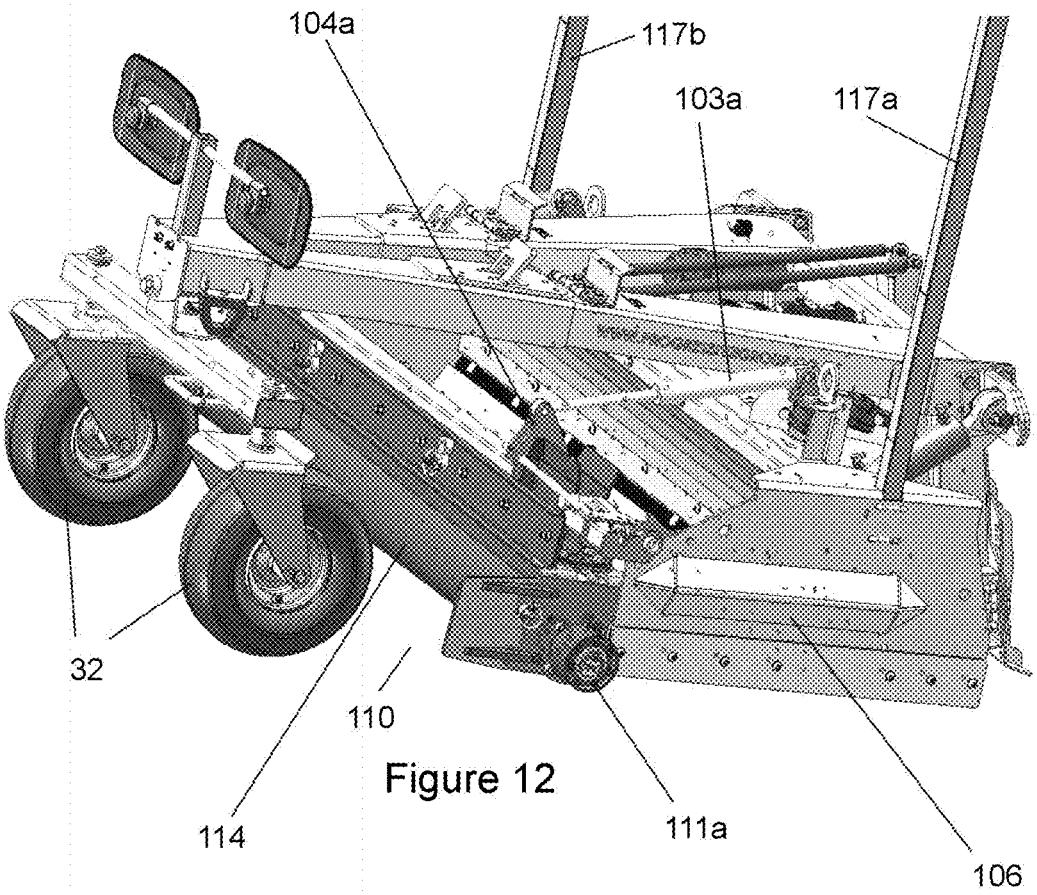
FIG. 12 is a side perspective view of an embodiment of a blade levelling assembly with the embodiment of a power drum of FIG. 12 in an accessory engaged position.

In FIGS. 11 and 12 we see the inclusion of a power drum assembly (generally indicated by arrow 110) such as a Harley rake (114) to the rear of structure support wheel (32). Features such as teeth or studs (115) may be provided on the Harley rake drum (114). While the invention allows for such an assembly (110) to be attached directly to side supports (106) by a rotatable mount (e.g. 105) at each end, the preferred arrangements utilise the rotatable transverse accessory mount (101) of the embodiment of FIG. 10 for easier fitment and removal of accessories (e.g. 110).

FIG. 12 provides a perspective view of the embodiment of FIG. 10 with the power drum accessory (110) of FIG. 11 (and such as detailed in FIG. 13) fitted and in the engaged position.

Figure 13:
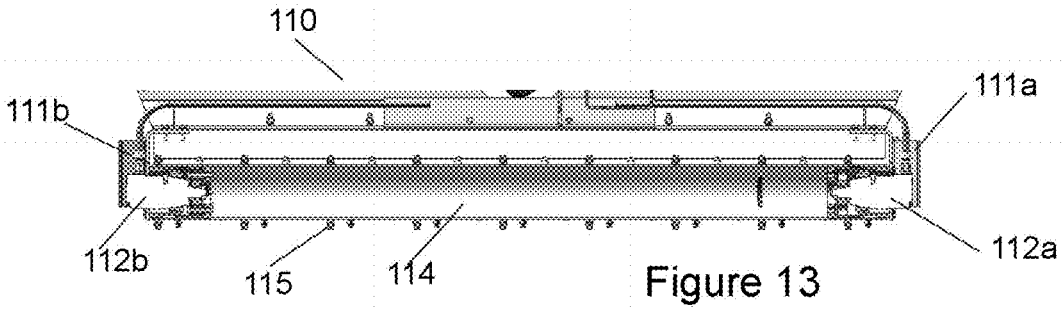
FIG. 13 is a cross-sectional transverse plane diagrammatic view of a power drum as used in the embodiments of FIGS. 11 and 12.

FIG. 13 illustrates a preferred power drum accessory (110) arrangement such as would be used in preferred embodiments as described in relation to FIGS. 11 and 13. As mentioned in the main body of the specification it is desirable for operators to be able to work close to boundaries and obstructions—e.g. foundation walls, kerbing, marker poles, etc. In practice this can usually be achieved in embodiments of the invention by minimising protrusions outside of the width of the blade (11), or as more readily seen in the pictures, outside of the side guards 106.

While the power drum could utilise a compact external hydraulic motor at each end the option for preferred embodiments is predominantly inboard hydraulic motors (112*a,b*) positioned largely within the drum (114) itself. In this situation only the protective cap and mount (111*a,b*) need extend outside of the planes defined by the side guards (106) while allowing the drum (114) to extend the full width within the extended vertical planes defined by the side guards (106).

The protrusions (115) from the drum (114) are defined by choice, and may be replaceable elements or formed into drum (114) itself. The user is open to choice here. Various types of teeth, blades, features may be provided along with different combinations thereof—for instance the user choice for breaking asphalt and road-seal may be different from dethatching and preparing areas covered with vegetation.

Less destructive drum choices are also envisaged—for instance the power drum may comprise a brush for finishing and screeding areas, finishing landscaped areas or lightly covering sown seed, or even removing excess materials and debris on finished areas (e.g. gravel chips on finish tar sealed roading and sidewalks etc). It is intended that there will be user choice in the selection of the properties of the power drum in a power drum assembly (110).

Figure 14:
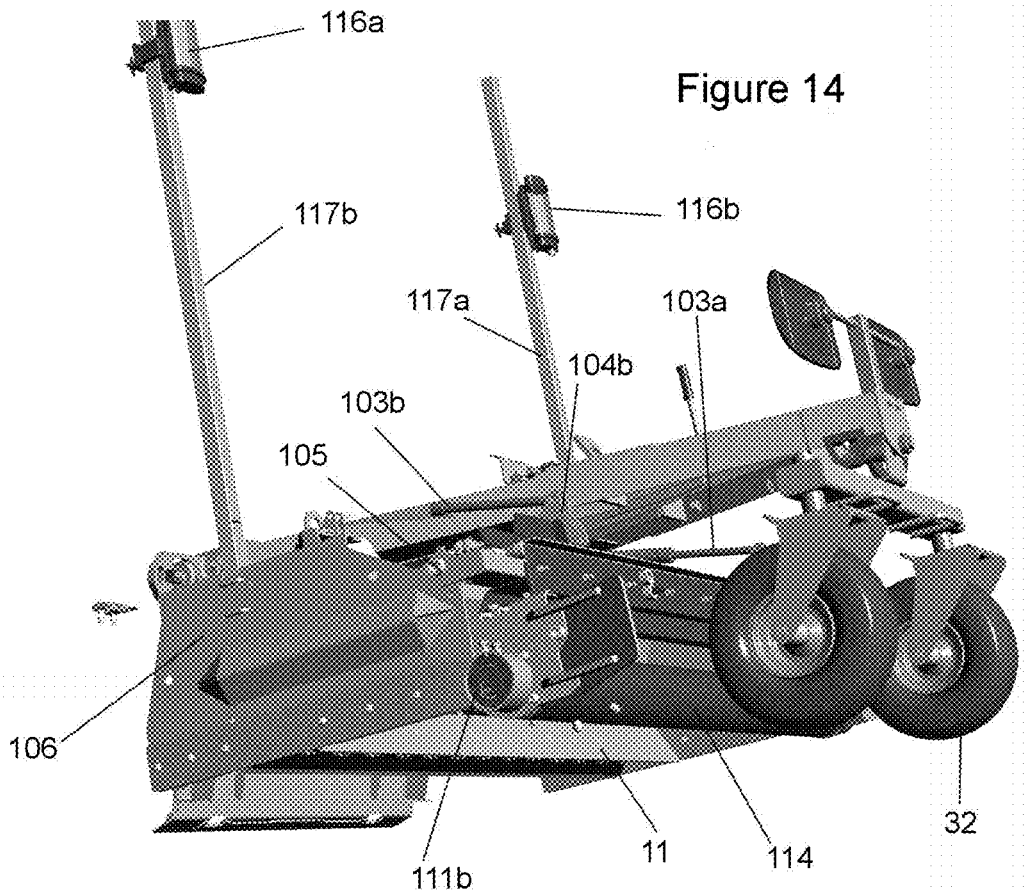
FIG. 14 is a side perspective view of an embodiment of a blade levelling assembly illustrating laser guidance receivers and mounts.

FIG. 14 illustrates a different perspective view of the embodiment of FIG. 12, and also shows the laser receiver unit (116*a,b*) guide poles (117*a,b*) which can employed with various embodiments of a levelling assembly (1) to enable it to be used a laser guidance and levelling system, or full 3D guidance system, such as becoming more common in the industry. There are various manufacturers of such systems (including, for instance, Leica®) which can provide accessory guidance and control systems able to work with position transmitters and solutions for use on various sites (and types of site). A potentially realisable advantage of various embodiments of the present invention is that when such laser assisted systems are used, any mounted accessories on the blade body portion also operate under the same laser assisted control as the blade and benefit from the advantages thereof. Hence a levelling assembly of the present invention to which various accessories can be fitted provides a useful advance in the industry—the multiple linkage arrangement connecting the blade body portion to the body attachment portion allows for angling of the accessory under operator control and/or in response to laser assisted control systems. No prior art accessories such Harley rakes/power drums, scarifiers, etc are able to be angled in response to changing ground contours and this represents a significant disadvantage (multiple passes with different accessories) in terms of time and accuracy for land and site preparation and contouring.

The following specifications in relation to the embodiments of FIG. 10 through 15 are not intended to be limiting but representative only of a currently most preferred embodiment, and to provide additional information to the skilled reader in understanding a best preferred embodiment of the invention. However, it should be appreciated that many of these parameters are open to user choice and to suit a particular job.

Typical Drum diameter: 170 mm (without teeth)

Typical Drum working width: 1.940 mm

Drum type: Steel, reversible in operation without affecting levelling operation

Typical Motor displacement (per side): 160-380 cc, depending on base machine size and hydraulic flow Typical Drum speed: adjustable from 0 to 240 RPM Typical Shaft diameter: 50 mm
Typical Number of teeth: 96
Typical Tooth type: 16 mm tungsten with button or flat top, depending on type of work
Typical Tooth height (from surface of drum): 30 mm
Typical Type of drive: Direct with resilient internal toothed drive
Typical Lubrication and maintenance points: zero, grease free pivots, internal, oil lubricated bearings
Typical Drum support bearings: 2×internal, oil lubricated, maintenance free
Typical Angle of retraction: 90 degrees to operating plane
Typical Engagement depth: Infinitely adjustable in operation from 100 above to 70 mm below blade height
Typical Stone barrier set height: 3 position in 40 mm increments
Typical Clearance height with drum removed: 560 mm
Typical Drum forward length from blade: 540 mm
Typical Drive motor extension width past side wing gusset: 20 mm
Typical Weight of drum and mount structure: 200 KG
Typical Weight of pivot mounting structure: 40 KG
Typical Locking mechanism: Over centre latch mechanism with positive tension in lock position
Typical Tilt from level: adjustable in manual or automatic mode, 0 to +/−12 degrees
Typical Control method: proportional hydraulic positioning using electronic machine control
Typical Grade Control: continuous automatic from 2D laser or 3D data file, Dual GNSS or TPS capable
Typical Tooth engagement depth: manual set via hydraulic cylinders
Typical Maximum main fall: set by laser, typical 0-15%
Typical Maximum cross fall: set by laser, typical 0-15%
Typical Accuracy of cut: Typical +/−3 mm from registered grade
Typical laser system provider—Leica®

Figure 15:
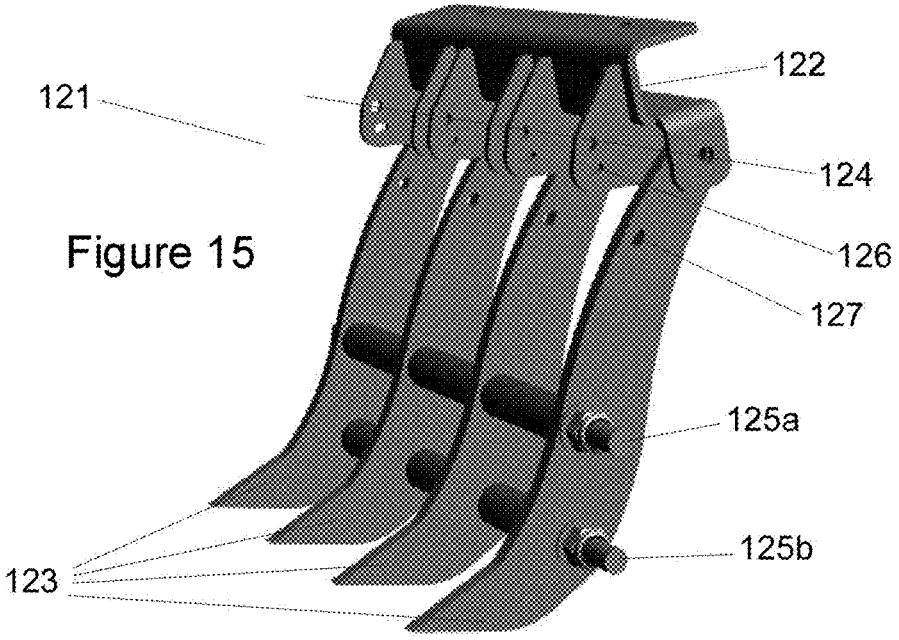
FIG. 15 is a perspective view of an embodiment of a scarifier accessory module.

FIG. 15 illustrates another accessory which may be fitted by an operator to an accessory mount (102). In this case a scarifier module (121) comprises a plurality of tines (123) are connected to an accessory mount portion (122) for fitting to the transverse mount (102). A pivot pin(s) (not shown) aligned with axis 124 allows for forward pivoting of the tines (123) allowing for them to drag freely when the levelling assembly is being reversed in operation. Alignment pins (125*a, b*) maintain spacing of the tines.

Apertures (126) and (127) in the mount and tine portions respectively allow an operator to temporarily lift the tines (123) and place a pin in to lock them in an up position. This can be useful for improving visibility for the operator in certain operations where the tines are not required. This can still used in conjunction with rotation of the transverse mount (102) to further lift the tines (123).

Not visible is a rear tab or bar at the rear of the mount ribs (128) which limits rearward travel of the tines (123) during forward movement of the levelling assembly (1), and to allow the tines (123) of the module (121) to be raised when the accessory bar is moved to an accessory retracted position.

It should also be envisaged that the scarifier modules could be positioned directly in front of the blade and mouldboards of the levelling assembly to allow them to be used in conjunction with another accessory on a transverse accessory mount (102), allowing an operator to readily use both in conjunction or alternate between use of the two accessories with relative ease of operation and adjustment. It should also be appreciated that a single scarifier module extending the full width of the mount (102) could be used, or multiple smaller modules used as required.

FIG. 16 illustrates a further modification to various embodiments of the present invention. In practice it is sometimes necessary for operators to work around obstructions on a site—these may be foundations for pillars or columns, and such like. As an alternative to the larger folding wheel carriage assembly (31, 32) of some embodiments of the invention, a simplified pivoting carriage with single pivot (132) can be provided and attached to a forwardly extending support (133), which may be fixed or removable. This arrangement gives a greater unobstructed distance (134) between the wheels (134) and projected general vertical plane of the side guards. This increased clearance make it easier for an operator to work close to, and around, obstructions—potentially providing a cleaner job with minimal manual follow up to finish problem areas. It should be noted that in a number of situations a forward carriage is desirable to help stop the levelling assembly (1) from nosing down into softer materials and maintaining a more accurate natural level for the tractor and levelling assembly combination.

As a variation of the aforesaid embodiments, there are occasionally situations where an operator may require additional flexibility in terms of being able to manipulate the orientation of the blade body portion (203). Such operations may include tilting the blade body portion forwardly or rearwardly (about a transverse axis—i.e. altering the pitch of the blade body portion). Other operations may include rotating the angle of the blade body portion (203) about a vertical 'z' axis—i.e. a yaw type movement. And various combinations of these operations and that of previously described embodiments. It should also be appreciated that these operations also affect any accessories which may also be mounted on the blade body portion (203).

In order to achieve these additional operations, various linkages of the previous embodiments (e,g, FIG. 8) may be substituted with linear actuators.

Figure 17:
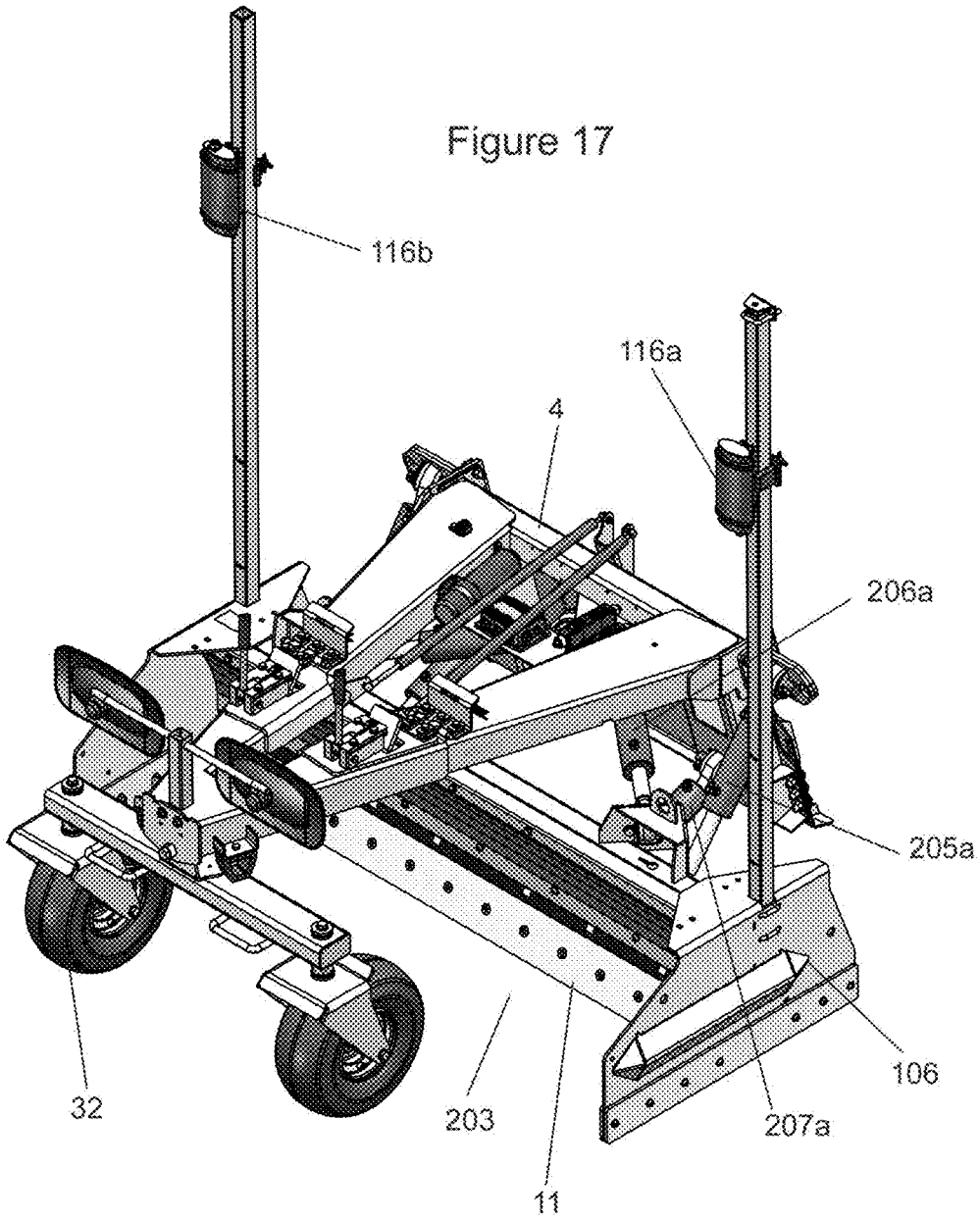
FIG. 17 is a top side perspective view of a further embodiment of a blade levelling capable of yaw and pitch adjustment of the blade body portion.

FIG. 17 refers a modification of embodiments such as shown in FIG. 8. For instance, to achieve pitch adjustment, linkages (7) (e.g. FIG. 8) of the previous embodiments are substituted with linear (typically hydraulic) actuators (207). These can be lengthened or shortened (ideally in tandem) to adjust pitch—we shall assume that other linkages/actuators remain at constant length while visualising this. Once a desired pitch has been achieved, their length may be maintained to retain this relative pitch (though see also more sophisticated embodiments discussed later). The beauty of this arrangement is that the actuators (207) function primarily as adjustable linkages, enabling these variant embodiments (e.g. FIG. 17) to still operate in the manner of the embodiment of FIG. 1 (for instance).

Figure 1:
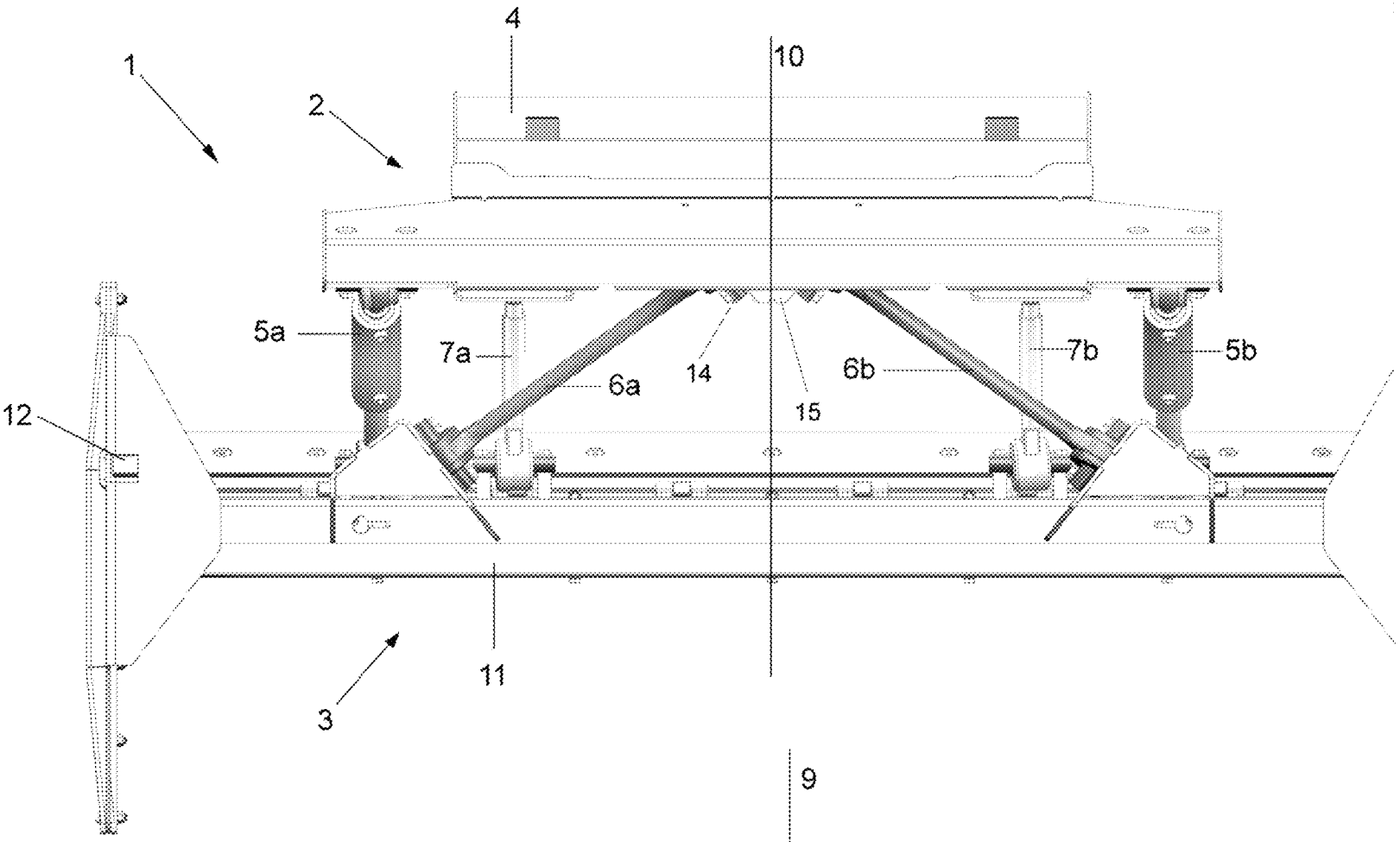
FIG. 1 is a partial plan view of one preferred embodiment of the present invention.

Providing linear actuators (206) to replace linkages (6) of FIG. 1 allows for the aforesaid yaw-like adjustments to be made. Here the operation is a little different and will typically involve extending one actuator (206) while retracting the other (206). The geometry is also a little different and these actions may also cause some roll-movement of the blade body portion (203). While this might be acceptable in some embodiments, providing actuators (207) instead of fixed length linkages (e.g. 7) can help compensate and allow adjustment to reduce these other pitch and/or roll changes when adjusting yaw.

In practice it is likely that an operator may employ changes to any one or more of pitch, yaw, and roll simultaneously. It is envisaged that in most cases the operation of such advanced embodiments of the present invention will be in conjunction with laser assisted control systems—such as, for instance, provided by companies such as Leica®. In these cases a control system for the actuators (205, 206, 207 where provided) will be coupled with the laser assisted control system to ensure the blade body portion (203) is maintained at the correct attitude/position as the leveller and vehicle travels across terrain.

It is envisaged that even with laser assisted embodiments, the operator may have direct (or indirect fly-by-wire type) control over pitch and yaw, as these are often more influenced by the type of terrain and material that the levelling assembly is working on. It also envisaged that these embodiments may also be used on non-laser assisted embodiments of a leveller assembly with direct control of the actuators (205-207 where provided) by the operator. There may also be fly-by-wire type assisted operation using computational means with a control system to enable the operator to more easily attain a particular attitude of the blade body portion (203)—it is envisaged that such embodiments might even used modified joysticks or roller-ball type controls for the operator, rather than individual controls for each actuator and/or set thereof (i.e. 205-207 where provided).

Figure 18:
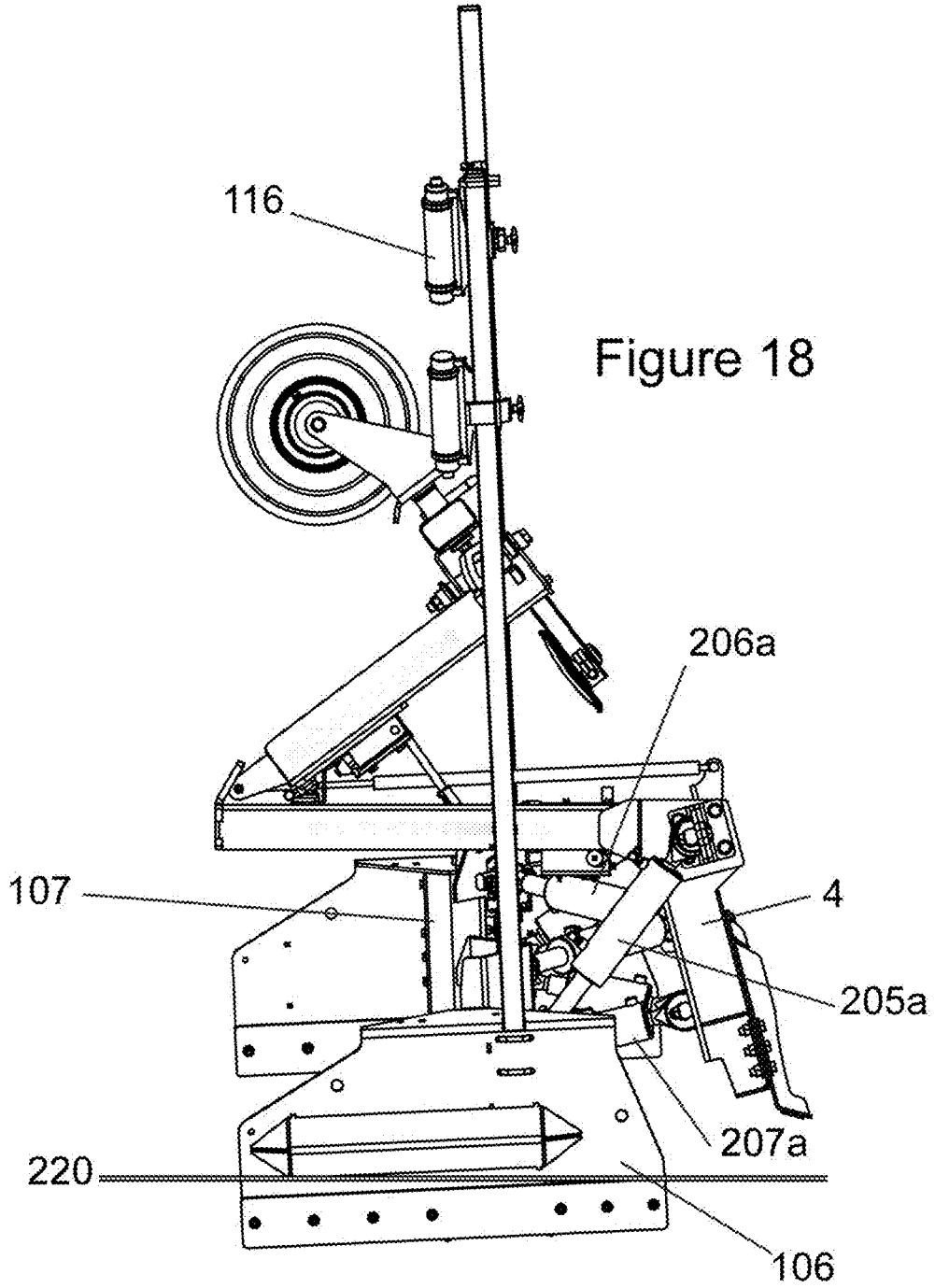
FIG. 18 is a side diagrammatic view of the embodiment of FIG. 17 in which the blade body portion is pitched forwardly.

FIG. 18 illustrates the embodiment of FIG. 17 in which actuators (207) have been shortened to enable the blade body portion to pitch forward relative to the ground (220)3. Once these actuators (207) have been set and maintained at the required length, and assuming also that actuators (206) are also maintained at constant length (assuming these are present instead of linkages (6)) then operation of actuators (205) will raise and lower the blade body portion (203) while maintaining substantially the same pitch. In fact, operation of actuators will be substantially the same in effect as for the embodiment of FIG. 1.

Figure 19:
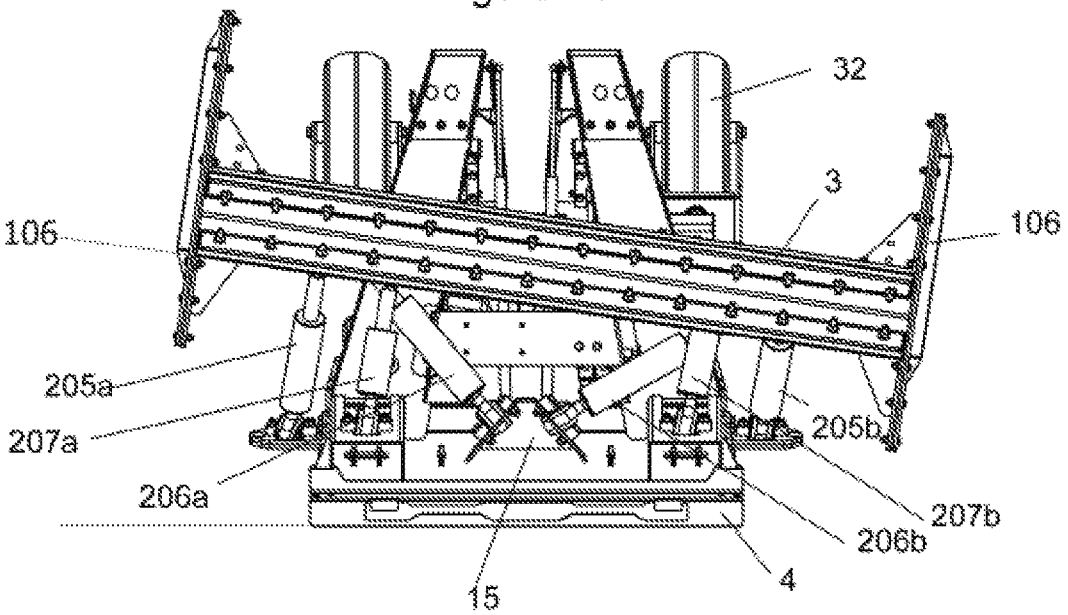
FIG. 19 is a plan diagrammatic view of the embodiment of FIGS. 17 and 18 with wheels in folded position and in which the yaw of the blade body portion about a vertical z-axis has been adjusted.

FIG. 19 illustrates the embodiment of FIG. 10 where the yaw (rotation about vertical z-axis) has been adjusted. Here, due to the geometry of the actuators, this also involves some adjustment of all the actuators (205, 206, 207) and not just actuators (206). The operations of raising, lowering, and roll such as illustrated in FIG. 3 are still possible though some additional adjustment to actuators (206, 207) may be required in addition to operation of actuators (205) if relative pitch and yaw attitudes are to be accurately maintained.

It should be envisaged that the embodiments of FIGS. 17 through 19 may also be further modified with the retractable mounting arrangements of figures Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The invention claimed is:

1. A blade leveling assembly comprising:

a body mounting portion and a blade body portion of a blade connected by a first set of connecting linkages and a second set of connecting linkages, the first set of connecting linkages being connected to the body mounting portion close to a middle thereof, when viewed in plan, being connected to the blade body portion outwardly of a middle thereof, when viewed in plan, the second set of connecting linkages being connected to the body mounting portion outwardly of the middle thereof, when viewed in plan, being connected to the blade body portion outwardly of the middle thereof and by a distance substantially equivalent from the middle of the blade body portion as a connection to the body mounting portion, when viewed in plan, one or more of the first set of connecting linkages and the second set of connecting linkages comprise adjustable length actuators;

side supporting elements disposed at or near each side of the blade body portion; and a rotatable accessory mounting portion comprising a transverse accessory mount configured to at least partially rotate about a transverse axis for the rotatable accessory mounting portion, said rotatable accessory mounting portion being positioned forward of the blade, and above the level of the blade.

2. The blade leveling assembly as claimed in claim 1, wherein said rotatable accessory mounting portion extends between said side supporting elements and is mounted to the side supporting elements, wherein the blade leveling assembly further comprises a mount rotation system configured to control a rotational attitude of the transverse accessory mount.

3. The blade leveling assembly as claimed in claim 1, wherein said side supporting elements comprise vertical side support guards positioned on either side of the blade portion and extending forwardly thereof.

4. The blade leveling assembly as claimed in claim 1, wherein said mount rotation is configured to alternate said accessory mounting portion, with an attached assembly, between two rotationally distinct positions about the transverse axis for the rotatable accessory.

5. The blade leveling assembly as claimed in claim 4, wherein said mount rotation system comprises a linear actuator pivotably connected at one end of the linear actuator to said transverse accessory mount, and to the blade body portion at a distal end of the linear actuator.

6. The blade leveling assembly as claimed in claim 1, wherein said mount rotation system is configured to be engaged in a free mode, which allows free rotation of said rotatable accessory about the transverse axis for the rotatable accessory.

7. The blade leveling assembly as claimed in claim 1, further comprising a rotatable drum assembly affixed to said rotatable accessory mounting portion.

8. The blade leveling assembly as claimed in claim 7, wherein said rotatable drum assembly comprises drum side mounts to which a rotatable drum portion is connected, said drum side mounts being connected to said transverse accessory mount and configured to act in conjunction with the transverse accessory mount to allow an arrangement of the drum side mounts and the transverse accessory mount to alternate between an accessory retracted position in which said rotatable drum portion is above the ground and the level of the lowest edge of said blade assembly, and an accessory engaged position in which the drum is contactable, or in proximity, with the ground.

9. The blade leveling assembly as claimed in claim 8, wherein said rotatable drum assembly includes a drum power system configured to effect powered rotation of said rotatable drum portion.

10. The blade leveling assembly as claimed in claim 9, wherein said drum power system is positioned within the body of a drum of the rotatable drum assembly.

11. The blade leveling assembly as claimed in claim 10, wherein said drum power system comprises an inboard hydraulic motor positioned with either end thereof within the body of the drum of the rotatable drum assembly.

12. The blade leveling assembly as claimed in claim 1, further comprising a scarifier assembly comprising one or more scarifier modules comprising a plurality of tines, the scarifier assembly being configured to be one of:

attached with said scarifier modules connected by a rotatable connection to the blade of the blade body portion in a first scarifier arrangement, and attached directly to the transverse accessory mount in a second scarifier arrangement.

13. The blade leveling assembly as claimed in claim 12, wherein, in either of the first scarifier arrangement and the second scarifier arrangement, rotational movement of the scarifier assembly is limited by the scarifier modules of the scarifier assembly bearing against the blade of the blade body portion in a direction.

14. The blade leveling assembly according to claim 1, wherein the first set of connecting linkages comprises two fixed length stabilizing arms, each of the fixed length stabilizing arms of the first set of connecting linkages being pivotably connected at one end to a fixed point on the body mounting portion, the fixed point being at or near the middle of the body mounting portion, and extending diagonally outwardly, when viewed in plan, from the fixed point on the body mounting portion, to pivotably connect to the blade body portion at a point outwardly of the middle of the blade body portion, the second set of connecting linkages comprises two fixed length stabilizing arms, each fixed length stabilizing arm of the second set of connecting linkages being pivotably connected at one end to the body mounting portion at a point outwardly and on either side of the middle of the body mounting portion when viewed in plan, and being pivotably connected at another end to the blade body portion at a point outwardly and on either side of the middle of the blade body portion, the first set of connecting linkages and the second set of connecting linkages being vertically separated from each other when the blade leveling assembly is viewed from the side, when the blade leveling assembly is viewed from the side, the points where the stabilizing arms of the first set of connecting linkages connect to the body mounting portion are vertically separated from the points where said stabilizing arms of the second set of connecting linkages connect to said body mounting portion, and when the blade leveling assembly is viewed from the side, the points where the stabilizing arms of the first set of connecting linkages connect to the blade body portion are vertically separated from said points where the stabilizing arms of the second set of connecting linkages connect to the blade body portion, the first set of connecting linkages and the second set of connecting linkages interact to allow relative movement of the blade body portion relative to the body mounting portion, said relative movement comprising:

vertical translational movement of the blade body portion relative to the body mounting portion, and rotational movement of the blade body portion, relative to the body mounting portion, about an axis normal to the general plane of the blade body portion.

15. The blade leveling assembly as claimed in claim 14, wherein operation of said second set of linkages effects changes in the pitch of the blade body portion.

16. The blade leveling assembly as claimed in claim 14, wherein operation of said first set of linkages effects changes in the yaw of the blade body portion.

17. The blade leveling assembly as claimed in claim 5, wherein said mount rotation system is configured to be engaged in a free mode, which allows free rotation of said rotatable accessory about the transverse axis for the rotatable accessory.

18. The blade leveling assembly as claimed in claim 1, further comprising a pivoting carriage assembly attached by a single upright pivot, allowing rotation of the pivoting carriage assembly about an upright axis, to a forwardly extending carriage support arm, wheels of the pivoting carriage assembly being mounted to the pivoting carriage assembly in a manner which does not allow pivoting of the wheels about an upright axis relative to the pivoting carriage assembly.

* * * * *